US010472864B2

(12) United States Patent
Takagi et al.

(10) Patent No.: US 10,472,864 B2
(45) Date of Patent: Nov. 12, 2019

(54) VEHICLE DOOR LOCK APPARATUS

(71) Applicant: ANSEI CORPORATION, Obu (JP)

(72) Inventors: Masaharu Takagi, Nagoya (JP); Satoshi Yamaji, Nagoya (JP)

(73) Assignee: ANSEI CORPORATION, Obu (JP)

( * ) Notice: Subject to any disclaimer, the term of this patent is extended or adjusted under 35 U.S.C. 154(b) by 338 days.

(21) Appl. No.: 15/653,700

(22) Filed: Jul. 19, 2017

(65) Prior Publication Data

US 2018/0023325 A1 Jan. 25, 2018

(30) Foreign Application Priority Data

Jul. 20, 2016 (JP) ..... 2016-141953
Jul. 20, 2016 (JP) ..... 2016-141954

(51) Int. Cl.

*E05B 77/46* (2014.01)
*E05B 85/20* (2014.01)
*E05B 85/00* (2014.01)
*E05B 77/00* (2014.01)

(52) U.S. Cl.

CPC ..... *E05B 77/46* (2013.01); *E05B 85/20* (2013.01); *E05B 77/00* (2013.01); *E05B 85/00* (2013.01)

(58) Field of Classification Search

CPC ..... E05B 77/46; E05B 77/465; E05B 77/48; E05B 77/00; E05B 85/20; E05B 85/24; E05B 85/243; E05B 85/26; E05B 85/00; E05B 85/02

USPC ..... 292/259

See application file for complete search history.

(56) References Cited

U.S. PATENT DOCUMENTS 2,934,930 A * 5/1960 Garvey ..... E05B 77/48 180/54.1
3,359,767 A * 12/1967 Arlauskas ..... E05B 77/48 180/281
5,802,894 A 9/1998 Jahrsetz et al.
6,416,088 B1 7/2002 Graute
6,419,286 B1 7/2002 Szablewski
8,789,861 B2 * 7/2014 Takayanagi ..... E05B 77/265 292/201
2003/0218340 A1 11/2003 Coleman et al.

(Continued)

FOREIGN PATENT DOCUMENTS

GB 2396656 A 6/2004
JP H0617960 Y2 5/1994

(Continued)

*Primary Examiner* — Nathan Cumar
(74) *Attorney, Agent, or Firm* — J-Tek Law PLLC; Jeffrey D. Tekanic; Scott T. Wakeman

(57) ABSTRACT

A vehicle door lock apparatus includes housings respectively having a housing chamber and a latch chamber formed therein, a latch mechanism housed in the latch chamber and being configured to retain a door closed with respect to a vehicle frame, and an actuating mechanism housed in the housing chamber for actuating the latch mechanism. A first and a second switch are housed in one of the latch chamber and the housing chamber, and respectively detect states of the actuating mechanism and the latch mechanism. A plurality of terminals is arranged in a first row and a second row in the housing. The first switch is connected to terminals in the first row and the second switch is connected to terminals in the second row such that the plurality of terminals is sandwiched by the first switch and the second switch.

20 Claims, 14 Drawing Sheets

(56) References Cited

U.S. PATENT DOCUMENTS

| | | | | |
|---|---|---|---|---|
| 2005/0140149 | A1 | 6/2005 | Umino | |
| 2005/0218661 | A1 | 10/2005 | Brose et al. | |
| 2006/0006671 | A1 | 1/2006 | Noel et al. | |
| 2006/0028029 | A1 | 2/2006 | Spurr | |
| 2006/0087129 | A1* | 4/2006 | Gotou | E05B 77/34 292/216 |
| 2008/0203737 | A1 | 8/2008 | Tomaszewski et al. | |
| 2010/0194120 | A1* | 8/2010 | Kaiser | E05B 81/20 292/198 |
| 2010/0327609 | A1 | 12/2010 | Akizuki et al. | |
| 2012/0056437 | A1* | 3/2012 | Takayanagi | E05B 77/265 292/118 |
| 2012/0068479 | A1 | 3/2012 | Bendel et al. | |
| 2013/0049379 | A1 | 2/2013 | Yokota et al. | |
| 2015/0048632 | A1 | 2/2015 | Menke | |
| 2015/0191945 | A1* | 7/2015 | Yamaguchi | E05B 85/20 292/196 |
| 2015/0259952 | A1 | 9/2015 | Barmscheidt | |
| 2015/0267441 | A1 | 9/2015 | Fuchs et al. | |
| 2015/0361694 | A1* | 12/2015 | Zeabari | E05B 85/02 361/752 |
| 2016/0017645 | A1 | 1/2016 | Tomaszewski et al. | |
| 2018/0016820 | A1 | 1/2018 | Takagi et al. | |
| 2018/0023327 | A1 | 1/2018 | Takagi et al. | |
| 2018/0073282 | A1 | 3/2018 | Takagi et al. | |
| 2018/0080262 | A1 | 3/2018 | Takagi et al. | |
| 2018/0148956 | A1 | 5/2018 | Takagi et al. | |

FOREIGN PATENT DOCUMENTS

| | | | |
|---|---|---|---|
| JP | 2002129806 | A | 5/2002 |
| JP | 2005188130 | A | 7/2005 |
| JP | 4163490 | B2 | 10/2008 |
| JP | 2012180702 | A | 9/2012 |
| JP | 2013117115 | A | 6/2013 |
| JP | 2014015717 | A | 1/2014 |
| JP | 5930273 | B2 | 6/2016 |

* cited by examiner

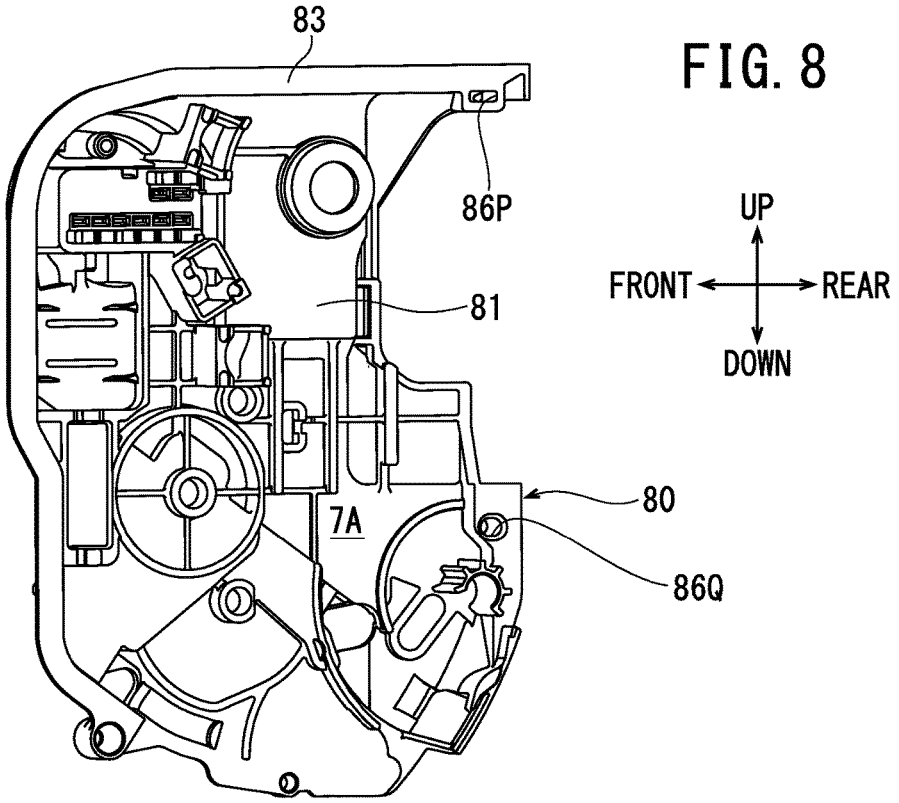
FIG. 8
FIG. 9
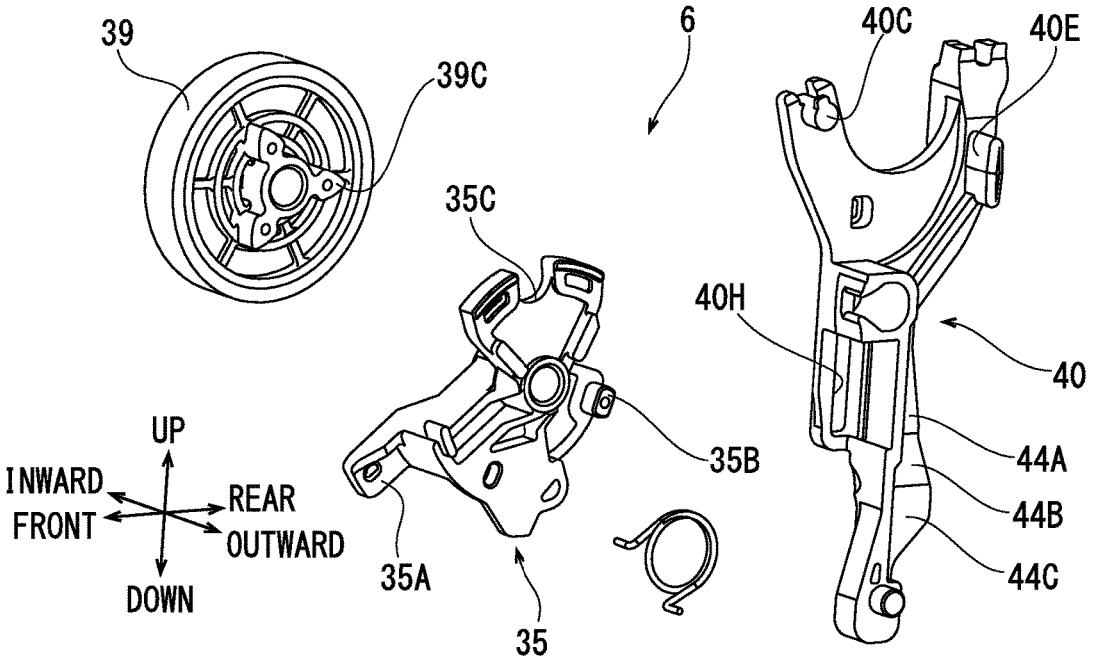

VEHICLE DOOR LOCK APPARATUS

CROSS-REFERENCE

This application claims the priority benefit of Japanese Patent Application Nos. 2016-141953 and 2016-141954 filed on Jul. 20, 2016, the entire contents of which are incorporated by reference as if fully set forth herein.

TECHNICAL FIELD

The present invention relates to a vehicle door lock apparatus.

BACKGROUND ART

Japanese Patent Laid-Open No. 2005-188130 and its family member US 2005/0140149 disclose a vehicle door lock apparatus having parts that are affixed to a vehicle frame and parts that are affixed to a door that is openable and closable with respect to the vehicle frame. Such a vehicle door lock apparatus is capable of holding the door closed with respect to the vehicle frame. For this purpose, this known vehicle door lock apparatus includes, among other things, a housing, a latch mechanism, an actuating mechanism (lock mechanism), a key sub-lever, a switch lever, and a plurality of switches.

In the vehicle door lock apparatus described in JP 2005-188130 and US 2005/0140149, a latch chamber (latch mechanism accommodating unit) and a housing chamber (lock mechanism accommodating unit) are formed in the interior of the housing. The latch mechanism is housed in the latch chamber. The latch mechanism is capable of holding the door closed with respect to the vehicle frame. The actuating mechanism is housed in the housing chamber and is capable of actuating the latch mechanism.

As shown in FIG. 4 of JP 2005-188130 and US 2005/0140149, a first switch is housed in the latch chamber. The first switch is capable of detecting a state of a fork that constitutes a part of the latch mechanism. As shown in FIG. 7 of JP 2005-188130 and US 2005/0140149, a second switch is housed in the housing chamber. The second switch is capable of detecting a state of the actuating mechanism in accordance with the displacement of the key sub-lever. As shown in FIG. 8 of JP 2005-188130 and US 2005/0140149, a third switch is housed in the housing chamber. The third switch is capable of detecting another state of the actuating mechanism in accordance with the displacement of the switch lever. The key sub-lever and the switch lever are supported by the housing such that they are pivotable about the same axis.

As shown in FIG. 3 of JP 2005-188130 and US 2005/0140149, a connector and a plurality of terminals are provided in the housing. A specific configuration of the terminals is unclear in these publications. However, the first to third switches are considered to be connected to the terminals.

Because the switches are disposed in a distributed (spaced apart) manner in this known vehicle door lock apparatus, the wires that connect the switches to the terminals must be relatively long and it is difficult to reduce the size of such a vehicle door lock apparatus.

SUMMARY OF THE INVENTION

In view of these circumstances, an object of the present teachings is to provide a vehicle door lock apparatus that can achieve a reduction in size.

In one embodiment of the present teachings, a vehicle door lock apparatus is configured to be fixed to a door that is openable and closable relative to a vehicle frame and is capable of holding the door in a closed state with respect to the vehicle frame. The vehicle door lock apparatus preferably comprises:

a housing having a latch chamber and a housing chamber formed in the interior thereof;

a latch mechanism housed in the latch chamber and capable of holding (retaining) the door closed with respect to the vehicle frame;

an actuating mechanism housed in the housing chamber and configured to actuate the latch mechanism;

a first switch housed in one of the latch chamber and the housing chamber and capable of detecting a first state of the latch mechanism or the actuating mechanism;

a second switch housed in the one of the latch chamber and the housing chamber and capable of detecting a second state of the latch mechanism or the actuating mechanism; and a plurality of terminals provided in the housing and arranged in a first row and a second row;

wherein the first switch is connected to the first row of the terminals and the second switch is connected to the second row of the terminals such that the first and second rows of the terminals are sandwiched by (interposed between) the first switch and the second switch.

Other aspects and advantages of the present invention will be apparent from the embodiments disclosed in the following description and the attached drawings, the illustrations exemplified in the drawings, and the general concept or gist of the invention disclosed in the entire description and drawings.

BRIEF DESCRIPTION OF THE DRAWINGS

FIG. 8 is a perspective view of a second housing of the first embodiment.

FIG. 9 is an exploded perspective view of a worm wheel, an inside ("I/S") lock lever, and a linearly moving lock lever of the first embodiment.

DETAILED DESCRIPTION OF PREFERRED EMBODIMENTS

Embodiments of the present teachings will be explained below with reference to the drawings.

First Embodiment

Figure 1:
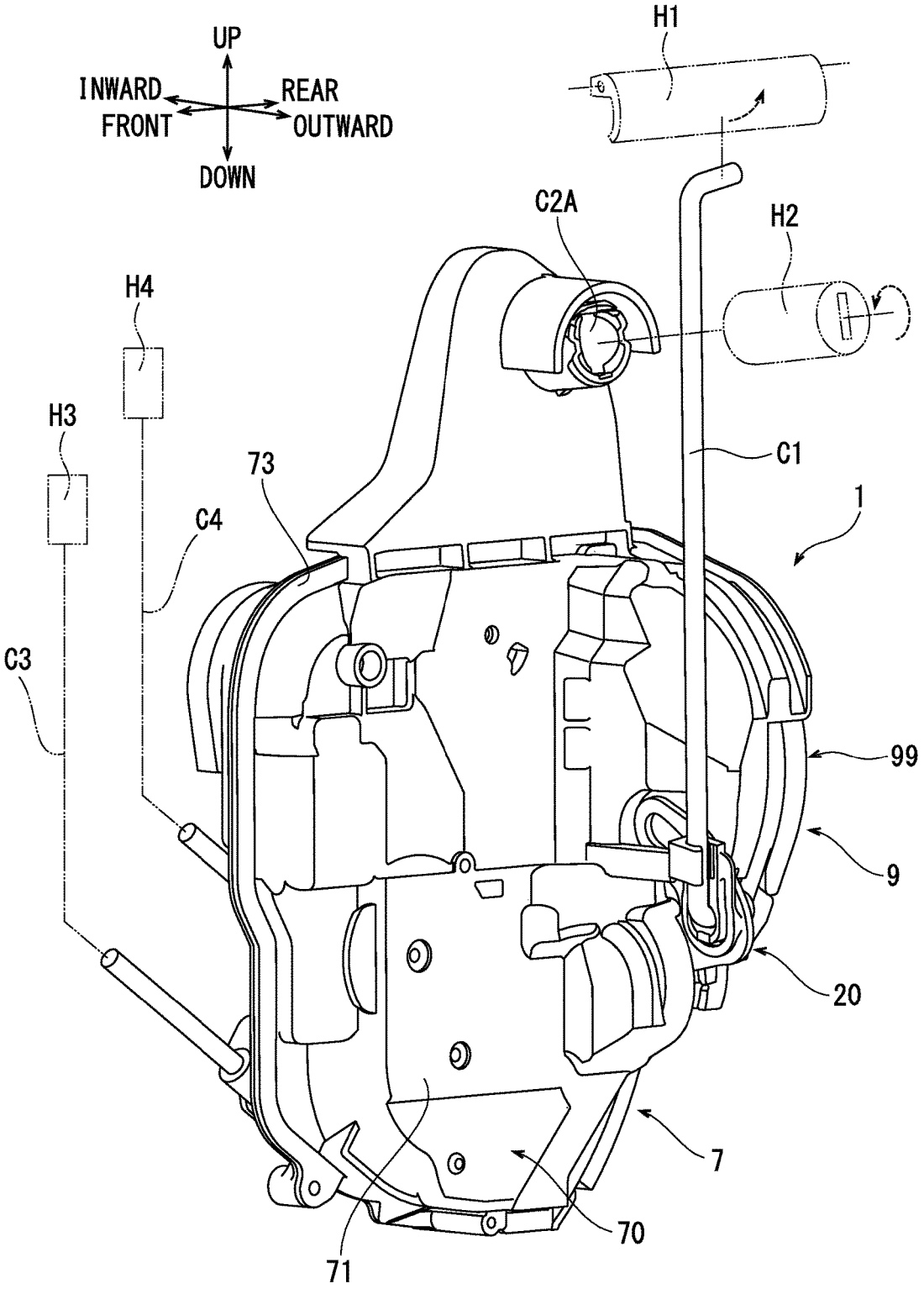
FIG. 1 is a perspective view of a vehicle door lock apparatus according to a first embodiment of the present teachings.
Figure 2:
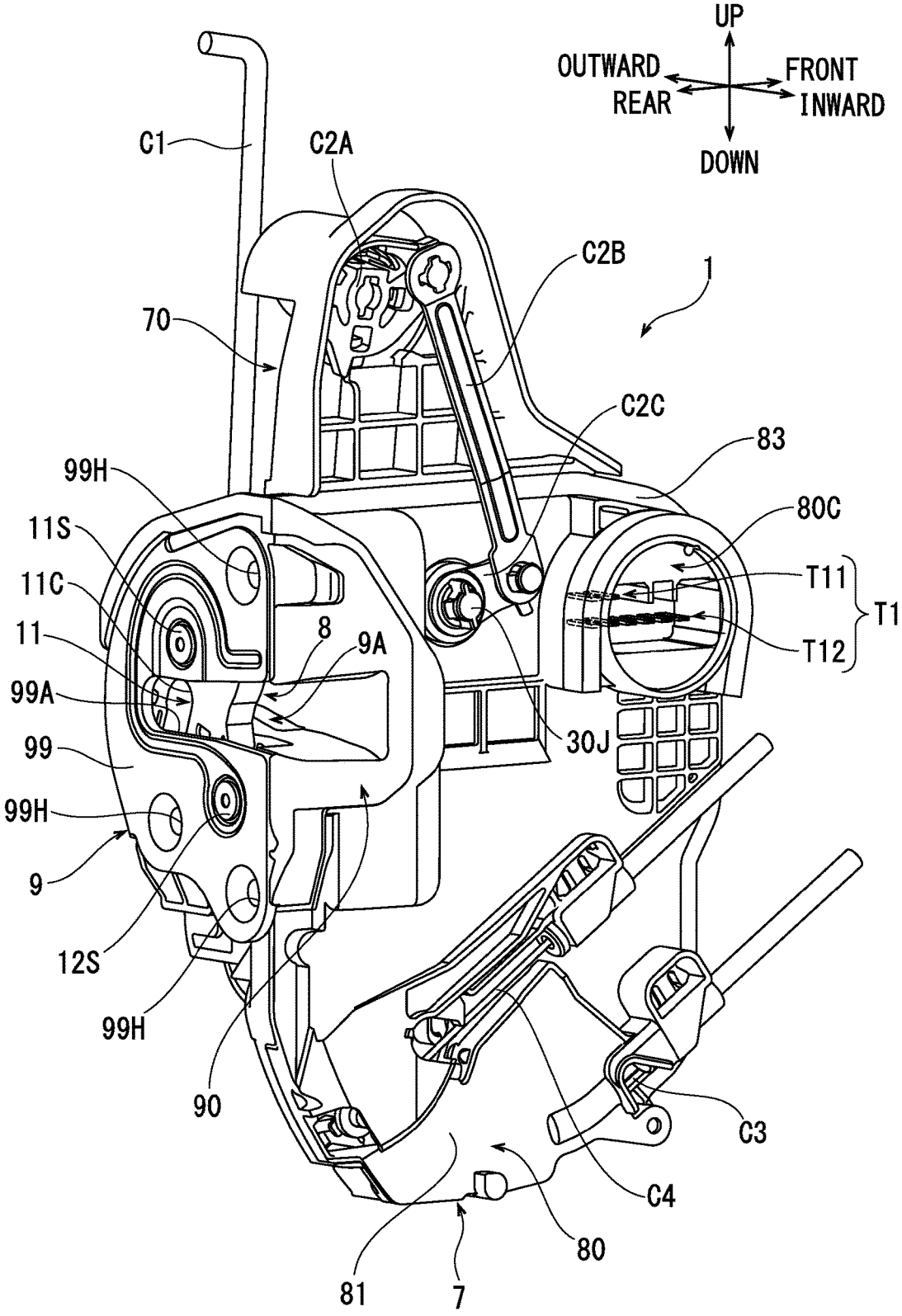
FIG. 2 is a perspective view of the vehicle door lock apparatus.

FIGS. 1 and 2 show a vehicle door lock apparatus 1 (hereinafter sometimes simply referred to as "door lock apparatus 1") according to a representative, non-limiting first embodiment of the present teachings. Although not shown in the Figures, the door lock apparatus 1 is configured to be affixed (attached) to a vehicle door that is openable and closable relative to a vehicle frame (chassis) of a vehicle, such as an automobile, a bus, a commercial vehicle, a truck, etc. By retaining (latching or holding) a striker that is affixed to the vehicle frame, the door lock apparatus 1 is capable of retaining (holding) the door closed with respect to the vehicle frame.

In FIGS. 1 and 2, the door lock apparatus 1 is configured to be disposed on the inside at the rear end of the door provided on the left side surface of the vehicle frame. It is noted that, when another door lock apparatus 1 is affixed to the rear end of the door provided on the right side surface of the vehicle frame, the two door lock apparatuses 1 will be disposed in a mirror image state. In addition or in the alternative, the door lock apparatus 1 according to the present teachings can be provided in (on) a tail gate, or another portion of the vehicle.

The front-rear direction and the up-down direction shown in FIGS. 1 and 2 are based on the front-rear (longitudinal) direction and the up-down (vertical or height) direction of the vehicle. The vehicle inward-outward (lateral) direction shown in FIGS. 1 and 2 is based on a person sitting in the cabin of the vehicle. The left surface side of the vehicle is set as the vehicle exterior and the opposite side is set as the vehicle interior. The front-rear direction, the up-down direction, and the vehicle inward-outward direction shown in FIG. 3 and the reference directions shown in the subsequent Figures correspond to the reference directions shown in FIGS. 1 and 2.

As shown in FIG. 1, an exterior door handle H1 and a key cylinder H2 are disposed on the outer surface of a not-shown door, to which the door lock apparatus 1 is affixed. An interior door lock knob H3 and an interior door handle H4 are disposed on the inner (interior) surface of the door that is exposed to (faces) the cabin of the vehicle. The exterior door handle H1 and the interior door handle H4 are representative, non-limiting examples of a "door handle" according to the present teaching.

An upper end portion of a transmission rod C1 is operably coupled to the exterior door handle H1. The door lock apparatus 1 is disposed downward of the exterior door handle H1 on the inside of the door. A lower end portion of the transmission rod C1 is operably coupled to an outside ("O/S") open lever 20 of the door lock apparatus 1.

The key cylinder H2 is retained so as to be rotatable integrally with a key-cylinder retainer C2A, which is rotatably (turnably) provided at the upper end portion of the door lock apparatus 1. As shown in FIG. 2, the upper end of a link rod C2B is operably coupled to the key-cylinder retainer C2A. The lower end of the link rod C2B is connected via a link lever C2C to an outside ("O/S") lock lever 30, which will explained below with reference to FIG. 5, etc.

As shown in FIG. 1, a first end of a transmission cable C3 is connected to the interior door lock knob H3. A first end of a transmission cable C4 is connected to the interior door handle H4. As shown in FIG. 2, a second end of the transmission cable C3 is drawn into the door lock apparatus 1 and connected to an inside ("I/S") lock lever 35, which will be explained below with reference to FIG. 5, etc. A second end of the transmission cable C4 is drawn into the door lock apparatus 1 and connected to an inside ("I/S") open lever 25, which will also be explained below with reference to FIG. 5, etc.

The door lock apparatus 1 includes a latch housing 9, as shown in FIGS. 1-4, and an actuating housing 7, as shown in FIGS. 1, 2, and 5-8. As shown in FIGS. 1 and 2, the actuating housing 7 is assembled onto (joined to) the latch housing 9. The latch housing 9 and the actuating housing 7 are representative, non-limiting examples of a "housing" according to the present teachings.

Figure 5:
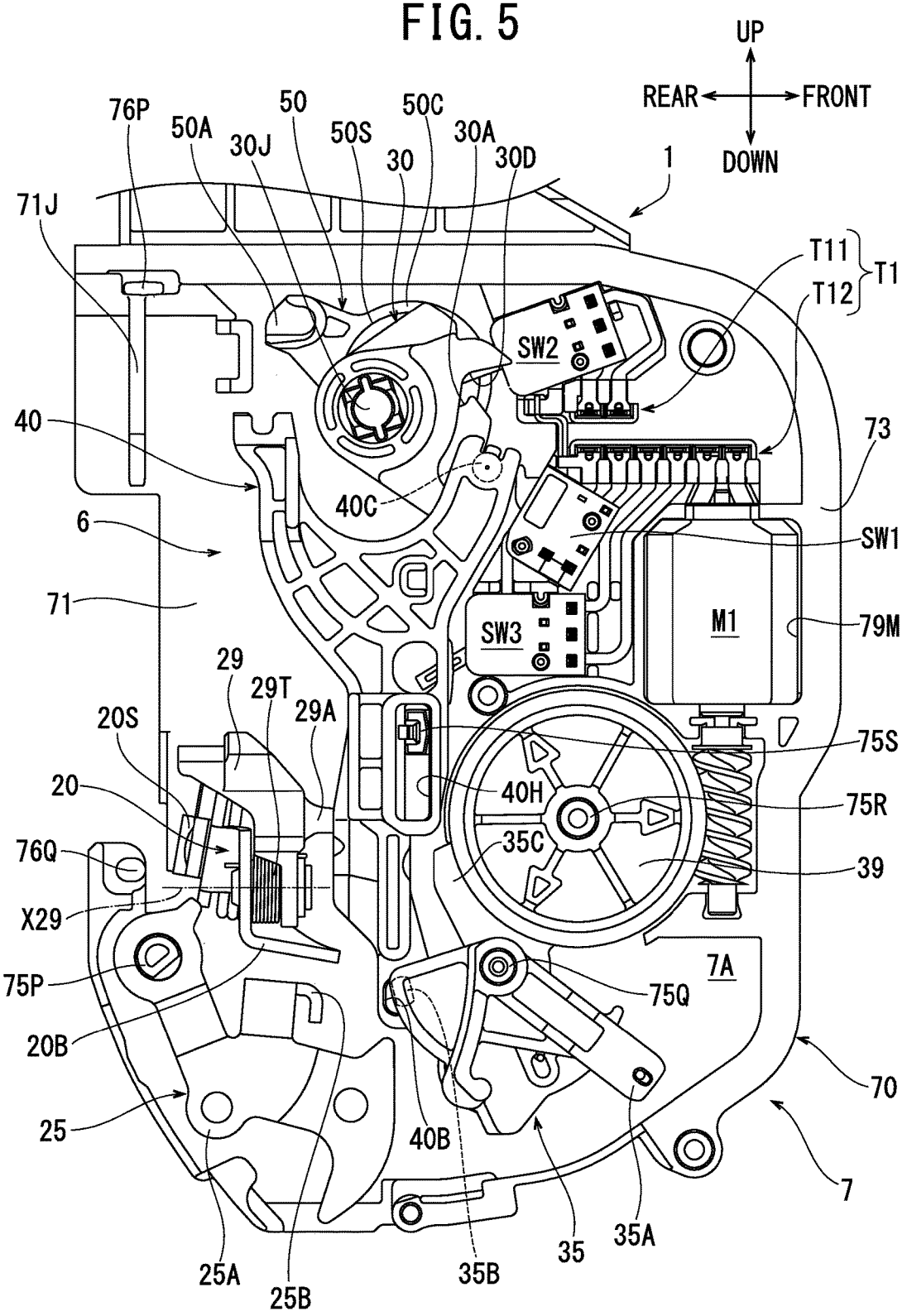
FIG. 5 is a front view of a first housing and an actuating mechanism of the first embodiment.
Figure 6:
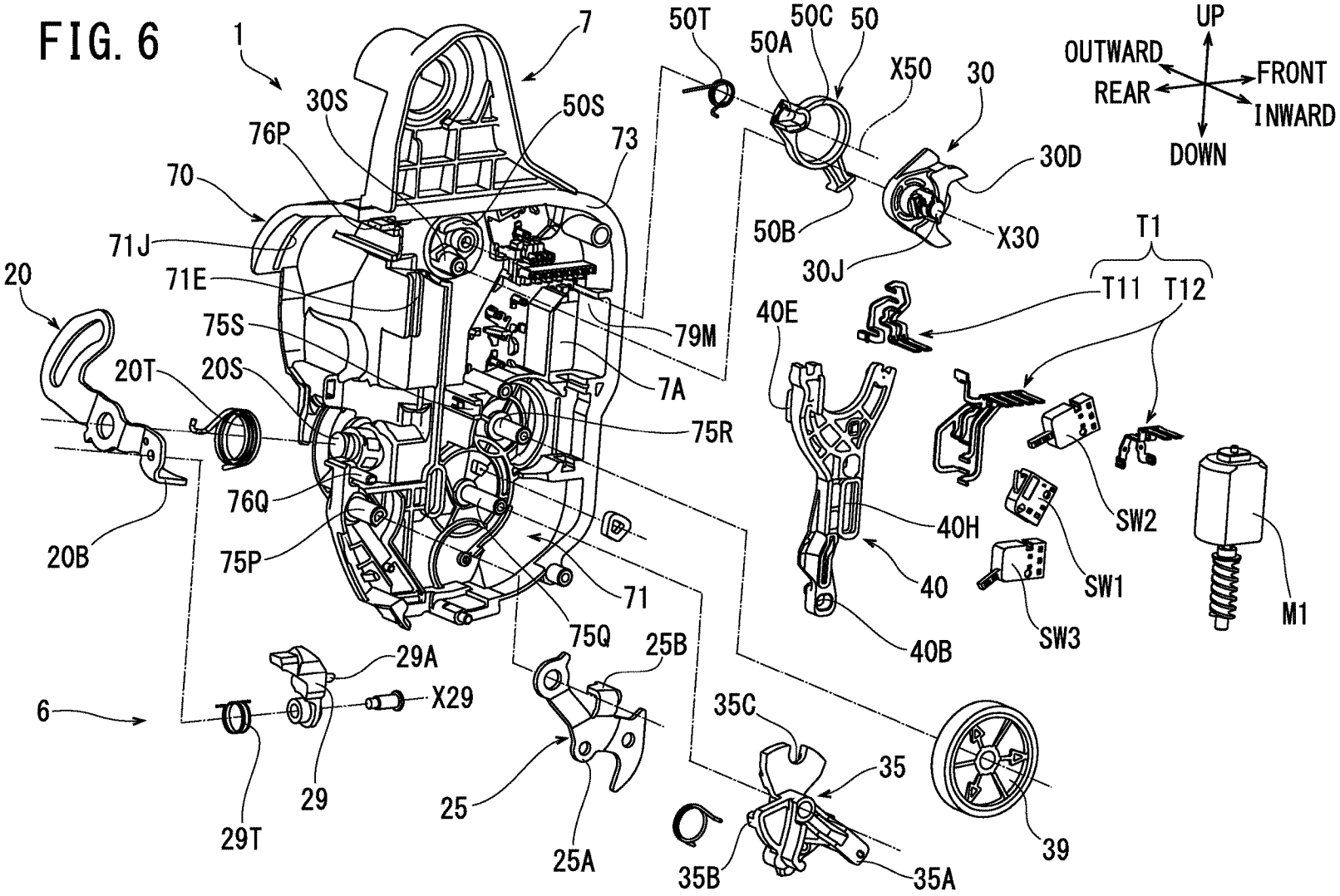
FIG. 6 is an exploded perspective view of the first housing and the actuating mechanism.
Figure 7:
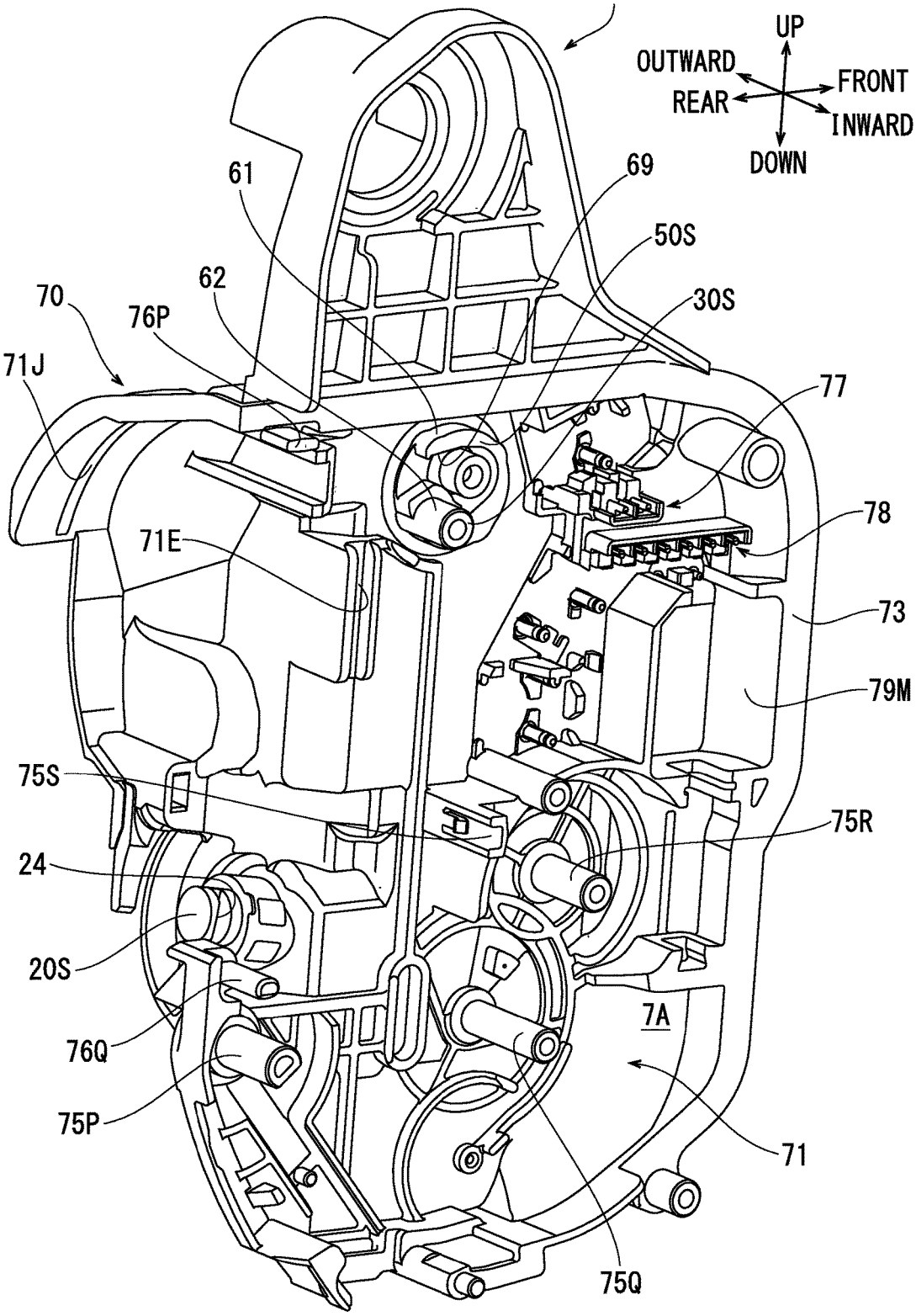
FIG. 7 is a perspective view of the housing.

As shown, e.g., in FIGS. 6-8, the actuating housing 7 includes a first housing 70 and a second housing 80, each made of resin. As shown in FIG. 7, the first housing 70 includes a first peripheral edge section 73 surrounding a first base wall 71. As shown in FIG. 8, the second housing 80 includes a second peripheral edge section 83 surrounding a second base wall 81. The second housing 80 is assembled onto (joined to) the first housing 70 by disposing the first base wall 71 opposite to the second base wall 81 and welding the first peripheral edge section 73 to the second peripheral edge section 83, whereby a housing chamber 7A is formed in the interior of the actuating housing 7. An actuating mechanism 6, as shown in FIGS. 5, 6, and 9-17, is housed in the housing chamber 7A.

Figure 4:
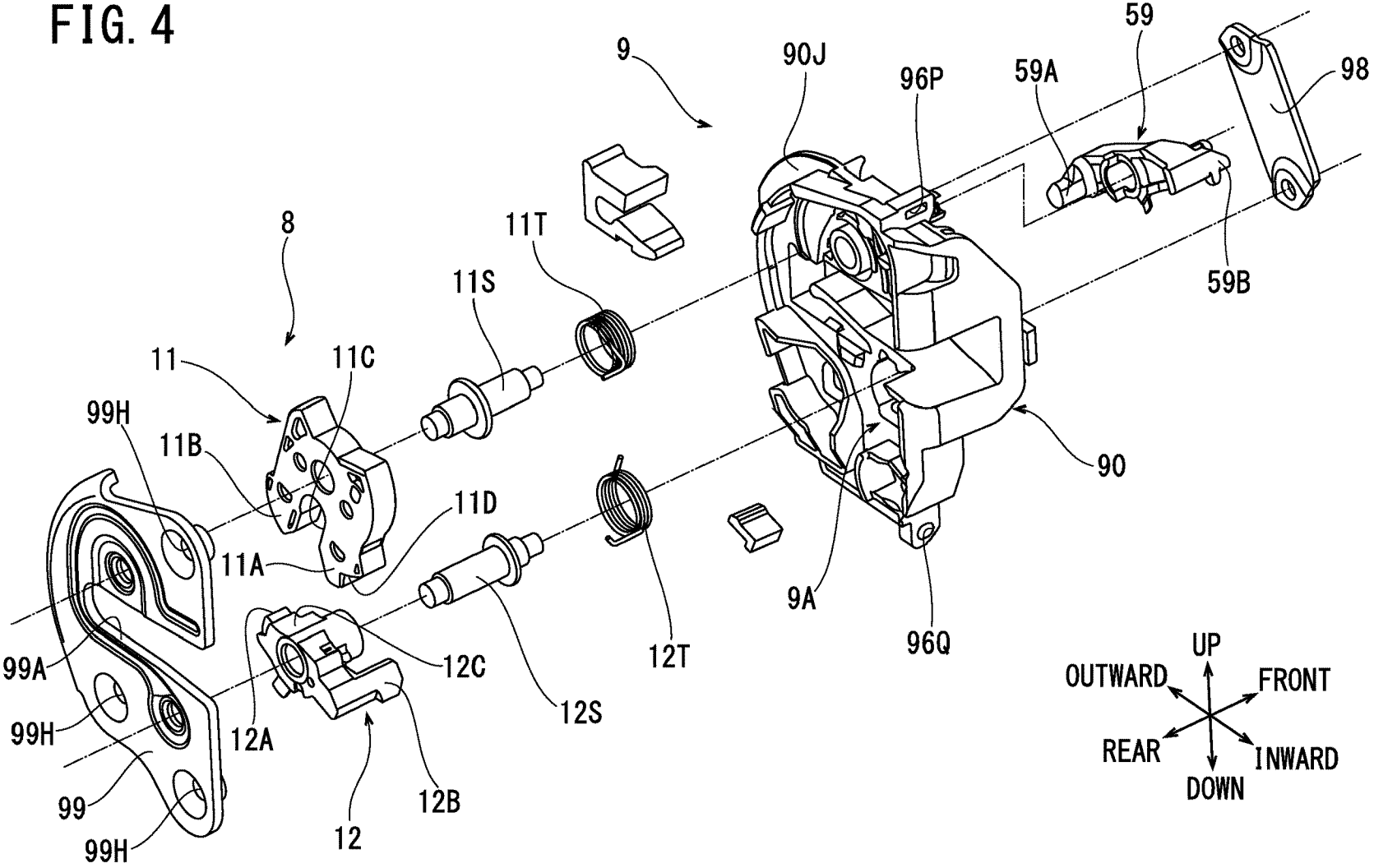
FIG. 4 is an exploded perspective view of the latch housing and the latch mechanism.

As shown in FIG. 4, the latch housing 9 includes a third housing 90 made of resin, as well as a base plate 99 and a back plate 98, which are each made from steel plate. A fork pivot shaft 11S and a pawl pivot shaft 12S are inserted through the third housing 90. The base plate 99 is disposed behind the third housing 90. The back plate 98 is disposed in front of the third housing 90. The rear end portions of the fork pivot shaft 11S and the pawl pivot shaft 12S are respectively crimped and thereby affixed to the base plate 99. The front end portions of the fork pivot shaft 11S and the pawl pivot shaft 12S are respectively crimped and thereby affixed to the back plate 98, whereby a latch chamber 9A is formed in the interior of the latch housing 9. A latch mechanism 8, as shown in FIGS. 2, 4, and 11-14, is housed in the latch chamber 9A.

As shown in FIGS. 5-7, first and second supports 76P and 76Q are formed in (on) the first housing 70. The first support 76P projects from the first base wall 71 near a rear and upper end portion in the first peripheral edge section 73 of the first housing 70. The second support 76Q projects from the first base wall 71 near a rear and lower end portion in the first peripheral edge section 73 of the first housing 70. The first and second supports 76P and 76Q each extend toward the second base wall 81 of the second housing 80.

Figure 3:
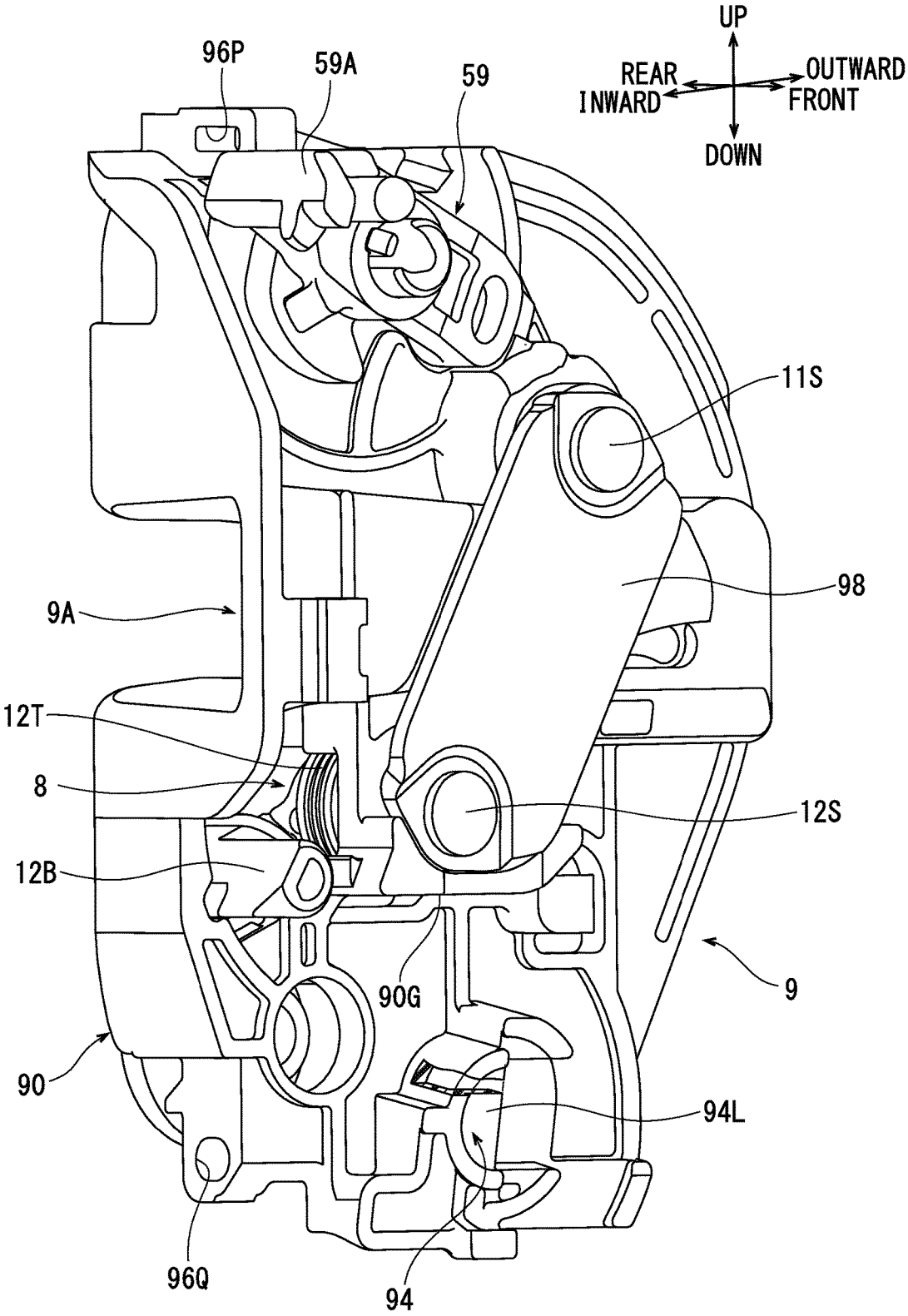
FIG. 3 is a perspective view of a latch housing and a latch mechanism of the first embodiment.

As shown in FIGS. 3 and 4, first and second insertion-through holes 96P and 96Q are formed in the third housing 90. The first insertion-through hole 96P penetrates through the upper end of the third housing 90 in the vehicle inward-outward direction. The second insertion-through hole 96Q penetrates through the lower end of the third housing 90 in the vehicle inward-outward direction.

As shown in FIG. 8, first and second slip-off preventing parts 86P and 86Q are formed as recesses (holes) in the second housing 80. The first slip-off preventing part 86P is a recess (hole) formed near a rear and upper end of the second peripheral edge section 83 of the second housing 80. The first slip-off preventing part 86P is aligned with the distal end of the first support 76P. The second slip-off preventing part 86Q is a recess (hole) formed near a rear and lower end of the second peripheral edge section 83 of the second housing 80. The second slip-off preventing part 86Q is aligned with the distal end of the second support 76Q.

Before the second housing 80 is assembled onto the first housing 70, the third housing 90 is provisionally assembled (mounted) onto the first housing 70. As shown, e.g., in FIG. 7, the first housing 70 includes a groove-like guide 71J formed in the rear end portion of the first base wall 71. As shown in FIG. 4, a rib 90J protrudes from an upper end face of the third housing 90 towards the vehicle exterior. By moving the third housing 90 towards to the first housing 70 while guiding the rib 90J into the guide 71J, the third housing 90 can be provisionally assembled with the first housing 70 in the proper position (orientation).

As a result, the intermediate segment of the first support 76P of the first housing 70 is inserted through the first insertion-through hole 96P of the third housing 90. Similarly, the intermediate segment of the second support 76Q of the first housing 70 is inserted through the second insertion-through hole 96Q of the third housing 90.

Subsequently, when the second housing 80 is assembled (mounted) onto the first housing 70, the distal end of the first support 76P of the first housing 70 is fit into the first slip-off preventing part 86P of the second housing 80. The distal end of the second support 76Q of the first housing 70 is fit into the second slip-off preventing part 86Q of the second housing 80. The first peripheral edge section 73 of the first housing 70 and the second peripheral edge section 83 of the second housing 80 are welded together, whereby the third housing 90 is joined to the first housing 70 and the second housing 80.

A plurality of fixing holes 99H and an entry opening 99A are formed (defined) in the base plate 99. Not-shown set screws are inserted through the rear end face of the door and are respectively screwed into the fixing holes 99H of the base plate 99, whereby the door lock apparatus 1 is affixed to the door such that the entry opening 99A is exposed at the rear end face of the door. When the door lock apparatus 1 moves in response to the opening and closing of the door, the striker affixed to the vehicle frame separates (exits) from or enters into the entry opening 99A.

As shown in FIG. 4, the latch mechanism 8 includes a fork 11 and a pawl 12. The fork 11 is pivotably supported by a fork pivot shaft 11S, which is disposed above the entry opening 99A. A torsion coil spring 11T is attached to the fork pivot shaft 11S. The pawl 12 is pivotably supported by the pawl pivot shaft 12S, which is disposed below the entry opening 99A. A torsion coil spring 12T is attached to the pawl pivot shaft 12S.

Figure 11:
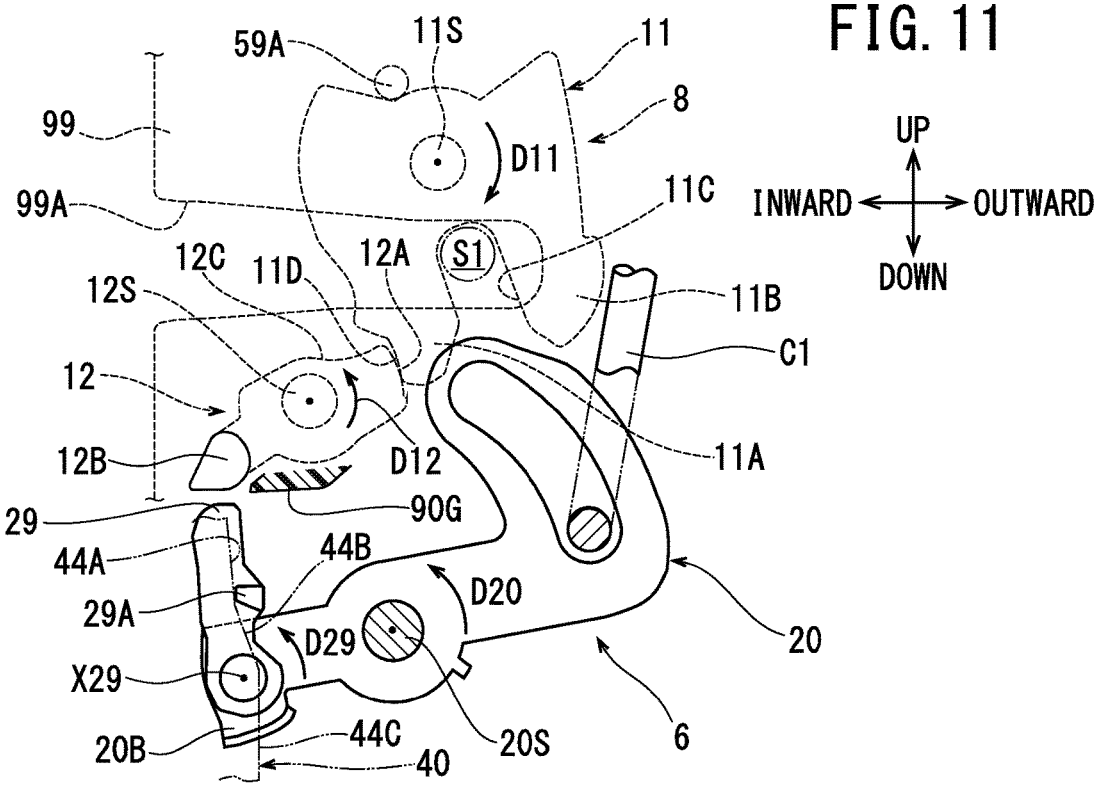
FIG. 11 is a first schematic view for explaining the operations of an outside ("O/S") open lever, an inertial lever, a fork, and a pawl of the first embodiment.

As shown in FIG. 11, the fork 11 is urged (biased) by the torsion coil spring 11T so as to pivot about the fork pivot shaft 11S in the direction D11. The portion of the fork 11 that is located on the side of the entry opening 99A has an inner convex segment 11A and an outer convex segment 11B. A striker S1, which is shown in FIG. 11 as having entered into the entry opening 99A, fits in a cutout 11C formed between the inner convex segment 11A and the outer convex segment 11B. In the state shown in FIG. 11, the fork 11 retains the striker S1 at the bottom of the entry opening 99A. A latch surface 11D configured to come into contact with a stopper surface 12A, which will be explained below, is formed at (on) the distal end of the inner convex segment 11A that faces the pawl 12.

The pawl 12 is urged by the torsion coil spring 12T so as to pivot in a D12 direction around the pawl pivot shaft 12S and retains a posture shown in FIG. 11.

The stopper surface 12A is formed in (on) a portion of the pawl 12 that is directed towards the bottom of the entry opening 99A in the orientation shown in FIG. 11. The stopper surface 12A is formed so as to face the latch surface 11D. An arc forming the stopper surface 12A is cut on the side that faces the fork 11. A sliding surface 12C that extends towards the pawl pivot shaft 12S is formed starting from the part (location) where the arc is cut. A contacted portion 12B is formed on the pawl 12 on the side that is opposite of the stopper surface 12A across the pawl pivot shaft 12S. As shown in FIG. 4, the contacted portion 12B projects forward and has a columnar shape. As shown in FIG. 3, the front end of the contacted portion 12B projects frontward from the latch chamber 9A through the third housing 90 and enters the housing chamber 7A.

Referring again to FIG. 11, when the fork 11 retains (holds) the striker S1 at the bottom of the entry opening 99A, the stopper surface 12A comes into contact with the latch surface 11D of the inner convex segment 11A, whereby the pawl 12 prevents the fork 11 from pivoting in the direction D11. The position of the fork 11 shown in FIG. 11 is the latch position that holds the striker S1 in the entry opening 99A.

Figure 12:
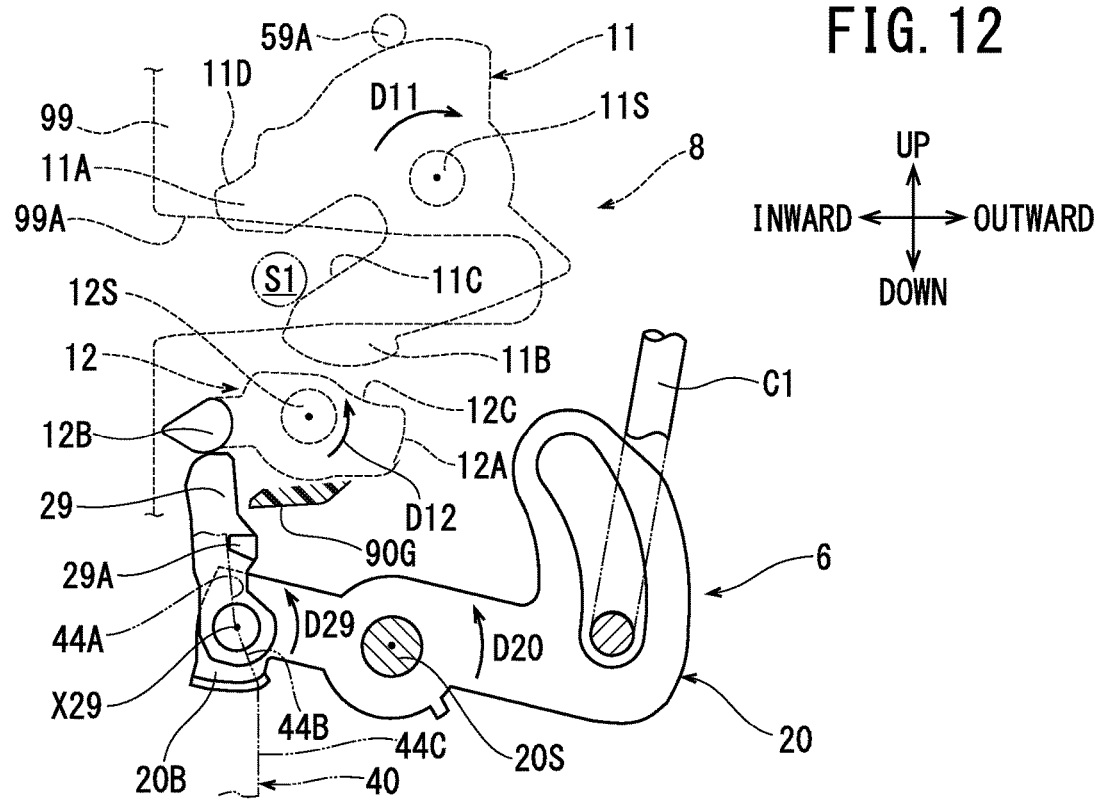
FIG. 12 is a second schematic view for explaining the operations of the O/S open lever, the inertial lever, the fork, and the pawl.

As shown in FIG. 12, when an inertial lever 29, which will be explained below, comes into contact with the contacted portion 12B of the pawl 12 and pushes the contacted portion 12B up, the pawl 12 pivots about the pawl pivot shaft 12S in the direction opposite of the direction D12 by overcoming the urging force of the torsion coil spring 12T. At this time, since the stopper surface 12A separates from the latch surface 11D, the pawl 12 no longer blocks the pivoting movement of the fork 11. Therefore, the fork 11 pivots about the fork pivot shaft 11S in the direction D11 due to the urging force of the torsion coil spring 11T so as to displace to the unlatch position, where the striker S1 is permitted (released) to move out of (exit) the entry opening 99A.

Conversely, when the striker S1 enters the entry opening 99A, the striker S1 pushes against the outer convex segment 11B, thereby causing the fork 11 to pivot in the direction opposite of the direction D11 and to return from the unlatch position shown in FIG. 12 to the latch position shown in FIG. 11. At this time, the distal end of the outer convex segment 11B and then the distal end of the inner convex section 11A sequentially come into slide-contact with the sliding surface 12C. When the inner convex segment 11A separates from the sliding surface 12C, the pawl 12 pivots in the direction D12 and returns to the original posture shown in FIG. 11. Therefore, the stopper surface 12A comes into contact with the latch surface 11D and fixes the pivoting movement of the fork 11 in the latch position. As a result, the latch mechanism 8 holds the door closed with respect to the vehicle frame.

As shown in FIGS. 3 and 4, a fork following lever 59 is pivotably supported on an upper part of the surface of the third housing 90 on the side of the housing chamber 7A. As shown in FIG. 4, a convex section 59A is formed at a first end portion of the fork following lever 59. As shown in FIGS. 11 and 12, the convex section 59A of the fork following lever 59 is in contact with the outer peripheral surface of the fork 11. Consequently, when the fork 11 displaces from the latch position to the unlatch position or vice versa, the fork following lever 59 pivots following the fork 11. As shown in FIGS. 3 and 4, a convex section 59B is formed at a second end portion of the fork following lever 59. The convex section 59B of the fork following lever 59 projects into the housing chamber 7A.

As shown in FIGS. 5, 6, 9, and 10, the actuating mechanism 6 includes the O/S open lever 20, the I/S open lever 25, the inertial lever 29, the O/S lock lever 30, the I/S lock lever 35, a linearly moving lock lever 40, an electric motor M1, a worm wheel 39, an adjuster switch ("SW") lever 50, a first switch SW1, a second switch SW2, a third switch SW3, and a plurality of terminals T1. These components are all housed inside the housing chamber 7A except for (i) one end portion of the O/S open lever 20 that projects to the outside of the actuating housing 7 as shown in FIG. 1 and (ii) projecting end portions of the plurality of terminals T1 that project from a connector mating part 80C as shown in FIG. 2.

The inertial lever 29 is a representative, non-limiting example of a "first lever" according to the present teachings. The linearly moving lock lever 40 is a representative, non-limiting example of the "second lever" according to the present teachings. The adjuster SW lever 50 is representative, non-limiting example of a "first detection lever" and a "third lever" according to the present teachings. The O/S lock lever 30 is representative, non-limiting example of a "second detection lever" and a "fourth lever" according to the present teachings.

As shown in FIGS. 6 and 7, the first housing 70 includes an outside ("O/S") open lever pivot shaft 20S that projects rearward at (from) a rear and lower portion of the first base wall 71.

As shown in FIGS. 5 to 7, a first shaft 75P is formed in (on) a rear and lower part of the first base wall 71 of the first housing 70. A second shaft 75Q is formed in (on) a part of the first base wall 71 that is farther forward than the first shaft 75P. A third shaft 75R and a fourth shaft 75S are formed in a part that is located substantially in the center of the first base wall 71. The first shaft 75P, the second shaft 75Q, the third shaft 75R, and the fourth shaft 75S respectively extend toward the second base wall 81 of the second housing 80.

As shown in FIG. 6, a torsion coil spring 20T is attached to the O/S open lever pivot shaft 20S. As shown in FIG. 11, the O/S open lever 20 is urged (biased) by the torsion coil spring 20T so as to pivot about the O/S open lever pivot shaft 20S in the direction D20.

As shown in FIG. 7, a fitting groove 24 is formed as a recess in the O/S open lever pivot shaft 20S. As shown in FIG. 3, a shaft receptacle 94, in which a fitting plate 94L is provided, is formed in the third housing 90. Although not shown in the Figures, the fitting groove 24 of the O/S open lever pivot shaft 20S fits with the fitting plate 94L of the shaft receptacle 94, whereby the O/S open lever 20 is prevented from slipping off from the O/S open lever pivot shaft 20S.

As shown in FIGS. 1 and 11, a first end of the O/S open lever 20 projects outward of the actuating housing 7. The lower end of the transmission rod C1 is coupled to this first end.

As shown in FIGS. 5 and 6, the inertial lever 29 is supported by a second end 20B of the O/S open lever 20 so as to be pivotable about a pivot axis X29 that extends in the front-rear direction. As shown in FIG. 11, the inertial lever 29 is urged (biased) by a torsion coil spring 29T (shown in FIG. 6) to pivot about the pivot axis X29 in the direction D29.

When the exterior door handle H1 is operated (e.g., manually pulled) to open the door, the transmission rod C1 moves downward as shown in FIG. 12, and the first end of the O/S open lever 20 is pushed down to. As a result thereof, the O/S open lever 20 pivots in the direction opposite of the direction D20 and raises the inertial lever 29.

As shown in FIGS. 5 and 6, the I/S open lever 25 is pivotably supported by the first shaft 75P. The second end of the transmission cable C4 (see FIGS. 1 and 2) is operably coupled to one end 25A of the I/S open lever 25 that is spaced downward from the first shaft 75P. That is, the I/S open lever 25 is operably coupled to the interior door handle H4 via the transmission cable C4.

As shown in FIGS. 5 and 6, an operating part 25B is formed on a part above the one end 25A of the I/S open lever 25. The I/S open lever 25 pivots counterclockwise when the interior door handle H4 is operated (e.g., manually pulled) to open the door. Consequently, the operating part 25B pushes the other end 20B of the O/S open lever 20 up and raises the inertial lever 29.

As shown in FIGS. 6 and 7, the first housing 70 includes an adjuster switch ("SW") lever pivot shaft (rounded portion) 50S that projects from an upper portion of the first base wall 71 toward the vehicle interior. An outside ("O/S") lock lever pivot shaft 30S projects from the end face of the adjuster SW lever pivot shaft 50S toward the vehicle interior.

Figure 18:
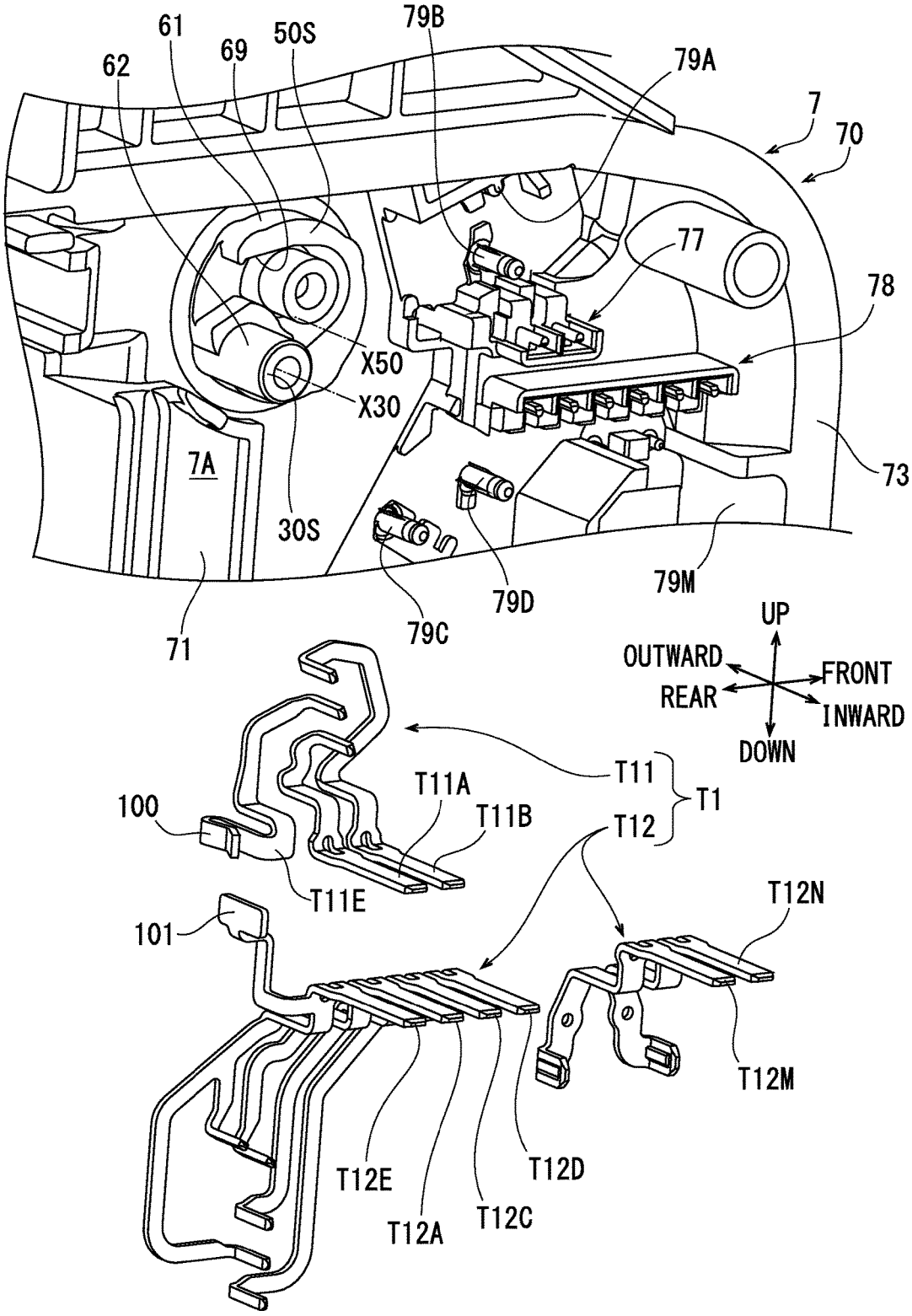
FIG. 18 is a partial perspective view showing the peripheries of first and second guide surfaces as well as a spring housing defined in the first housing and the plurality of terminals.

More specifically, as shown in FIG. 18, the adjuster SW lever pivot shaft 50S is a substantially columnar body, and an at least substantially annular first guide surface 61 is formed (defined) on the outer circumference thereof. The first guide surface 61 is constituted by a cylindrical surface and by curved surfaces that slightly swell (bulge, protrude) from (at) a plurality of portions of the cylindrical surface. The first guide surface 61 defines a first axis X50 that extends in the vehicle inward-outward direction.

Figure 17:
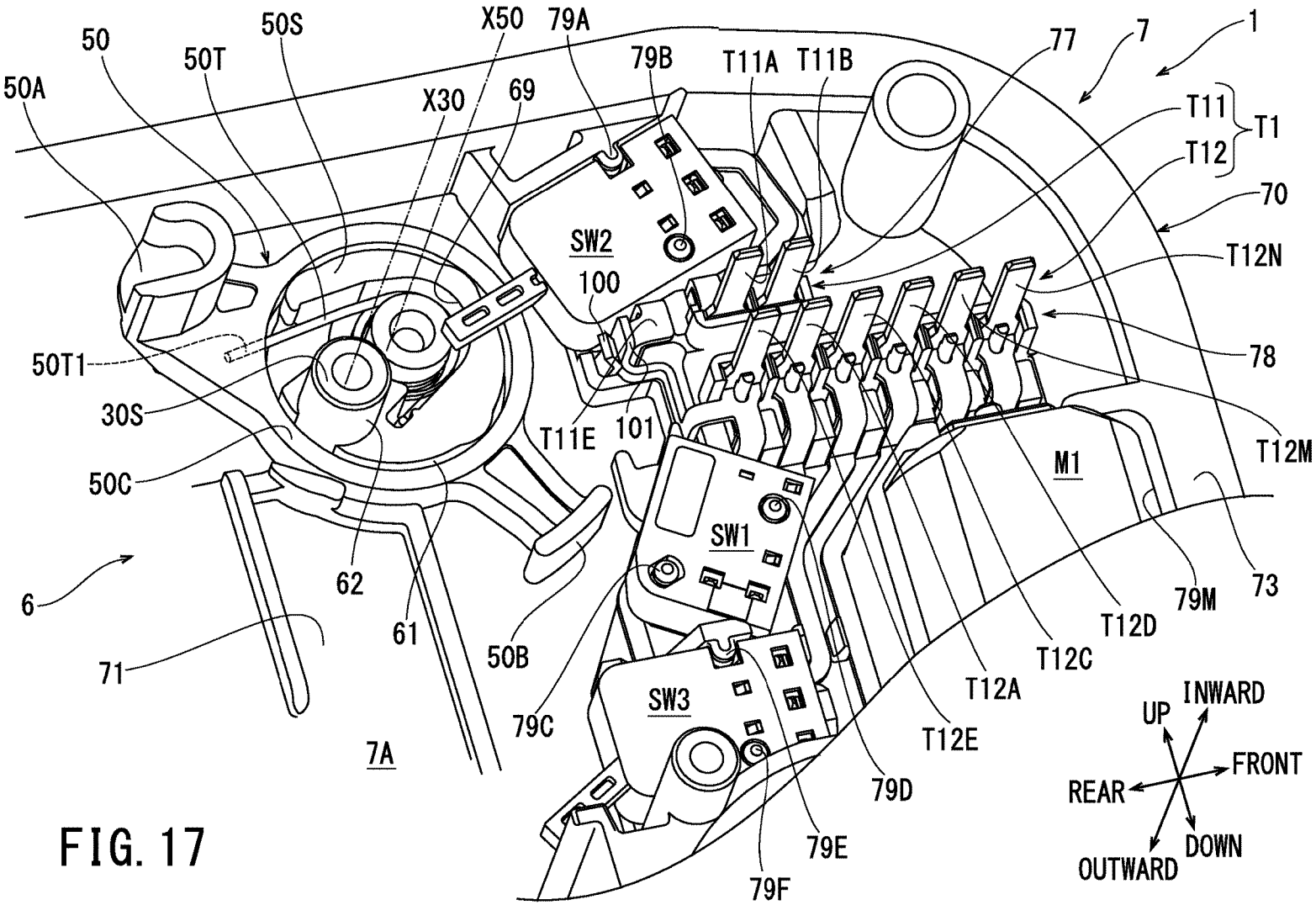
FIG. 17 is a partial perspective view showing the positional relationship of the adjuster SW lever, a spring, first to third switches, a plurality of terminals, and an electric motor relative to each other.

A spring housing 69 is formed as a recess extending in the vehicle outward direction and is partially defined by a radially-inward side of the first guide surface 61 of the adjuster SW lever pivot shaft 50S, i.e. the spring housing 69 is located within the upper rear portion of the end face of the adjuster SW lever pivot shaft 50S. As shown in FIG. 17, an urging (biasing) spring 50T, e.g., a torsion coil spring, is housed within the spring housing 69.

As shown in FIG. 18, the O/S lock lever pivot shaft 30S is shaped as a cylindrical body, and a cylindrical second guide surface 62 is formed on the outer circumference thereof. The second guide surface 62 is located farther in the vehicle inward direction than the first guide surface 61, is radially spaced apart from the first axis X50 and is located below and/or rearward from the spring housing 69. The second guide surface 62 defines a second axis X30 that is shifted in the vehicle downward direction relative to the first axis X50 and extends in parallel to the first axis X50. The outer diameter of the second guide surface 62 is less than one half of the outer diameter of the first guide surface 61.

Figure 15:
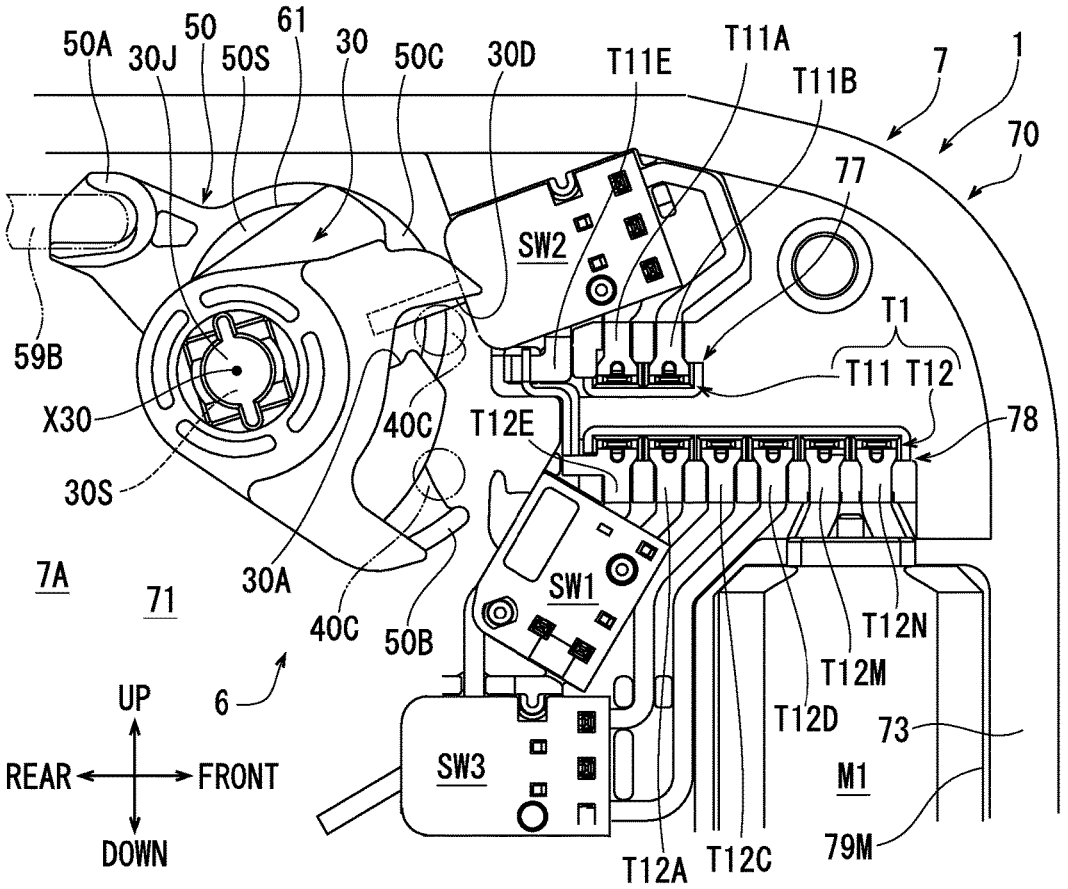
FIG. 15 is a schematic view for explaining the operations of an adjuster switch ("SW") lever and a first switch.
Figure 16:
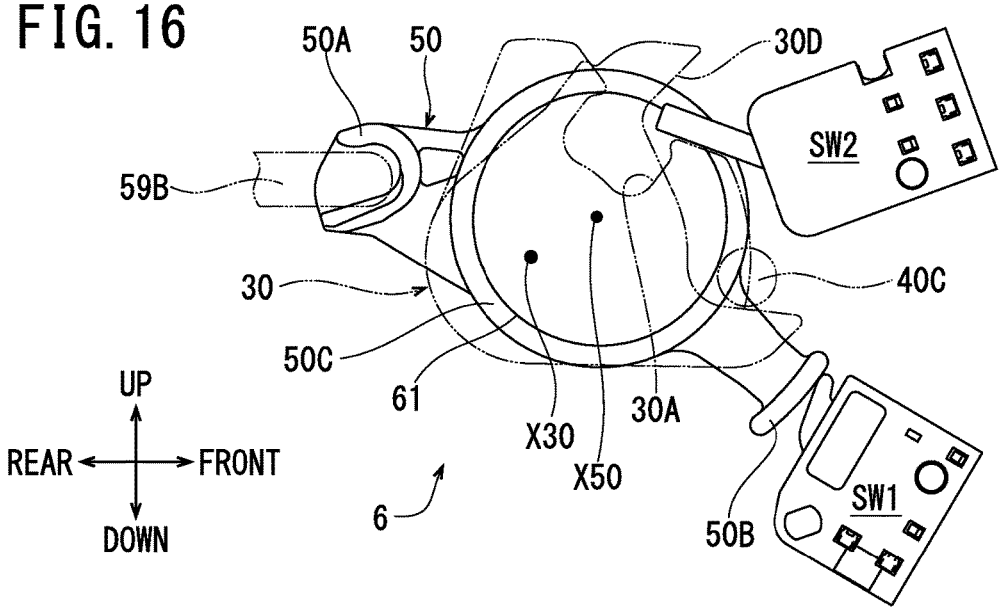
FIG. 16 is a schematic view for explaining the operations of an outside ("O/S") lock lever and a second switch.

As shown, e.g., in FIGS. 15 to 17, the adjuster SW lever 50 includes a ring 50C, an input part 50A, and an output part 50B. The inner diameter of the ring 50C is slightly larger than the outer diameter of the first guide surface 61. As shown in FIG. 17, the ring 50C is rotatably disposed around the first guide surface 61, whereby the adjuster SW lever 50 is supported by the adjuster SW lever pivot shaft 50S so as to be pivotable about the first axis X50. One end 50T1 of the torsion coil spring 50T engages with (in) the ring 50C. Consequently, in the view shown in FIG. 15, the adjuster SW lever 50 is urged (biased) in the clockwise direction. The input part 50A projects rearward from a rear portion of the outer circumferential surface of the ring 50C. As shown in FIGS. 15 and 16, a convex portion 59B of the fork following lever 59 (see FIG. 3) is coupled to the input part 50A. As shown in FIGS. 15 to 17, the output part 50B projects frontward and downward from a front, downward portion of the outer circumferential surface of the ring 50C and extends to the vicinity of (adjacent to) the first switch SW1.

When the fork following lever 59 pivots in response to movement of the fork 11 to the unlatch position, the fork following lever 59 causes the adjuster SW lever 50 to pivot in the counterclockwise direction (as viewed in FIGS. 15 and 16) from the position shown in FIG. 15 to the position shown in FIG. 16; this displacement (movement) of the output part 50B causes the first switch SW1 to be turned ON. The position of the adjuster SW lever 50 shown in FIG. 15 serves as an interior light (dome light) OFF position corresponding to the latched position of the fork 11. The position of the adjuster SW lever 50 shown in FIGS. 5, 10, and 17 also serves as the interior light (dome light) OFF position. The position of the adjuster SW lever 50 shown in FIG. 16 is an interior light (dome light) ON position corresponding to the unlatched position of the fork 11. The ON/OFF signal provided by the first switch SW1 is used to turn ON and OFF the vehicle interior light (i.e. the dome light within the passenger cabin of the vehicle). The state of the fork 11 detected by the first switch SW1 is a representative, non-limiting example of a "first state" according to the present teachings.

As shown, e.g., in FIGS. 5, 6, and 15, the O/S lock lever 30 is supported by the O/S lock lever pivot shaft 30S so as to be pivotable about the second axis X30. Although not shown in the Figures, a shaft hole (blind hole) is defined within the O/S lock lever 30 and has an inner diameter that is slightly larger than the outer diameter of the second guide surface 62 of the O/S lock lever pivot shaft 30S. The O/S lock lever pivot shaft 30S is inserted into the shaft hole to place the O/S lock lever 30 adjacent to the adjuster SW lever 50. That is, the adjuster SW lever 50 and the O/S lock lever 30 are thereby stacked (disposed in series) in the vehicle inward-outward direction, in which both the first axis X50 and the second axis X30 extend.

As shown, e.g., in FIGS. 15 and 16, the O/S lock lever 30 includes a switch engaging part 30A, an engaging concave part 30D, and a coupling shaft 30J. The switch engaging part 30A is recessed in the radial inward direction of the second axis X30. A lever of the second switch SW2 engages in the inside of the switch engaging part 30A. The engaging concave part 30D is recessed in the radial inward direction farther in the vehicle inward direction than the switch engaging part 30A. The coupling shaft 30J projects from a surface adjacent to the engaging concave part 30D in the vehicle inward direction and the second axis X30 serves as its rotational axis. As shown in FIG. 2, the coupling shaft 30J projects to the outside of the second housing 80. The link lever C2C is fixed to the distal end portion of the coupling shaft 30J so as to be integrally rotatable therewith.

Referring to FIG. 5, the O/S lock lever 30 pivots counterclockwise in response to a locking operation being performed on the key cylinder H2. On the other hand, the O/S lock lever 30 pivots clockwise in response to an unlocking operation being performed on the key cylinder H2. For example, the O/S lock lever 30 pivots from the position shown in FIG. 15 to the position indicated by an alternate long and two short dashes line in FIG. 16 and thereby turns ON the second switch SW2. The ON/OFF signal of the second switch SW2 is used to control the locking and unlocking of the door and to ascertain the state of the door lock apparatus 1. The state of the O/S lock lever 30 detected by the second switch SW2 is a representative, non-limiting example of a "second state" according to the present teachings.

As shown in FIGS. 5 and 6, the I/S lock lever 35 is pivotably supported by the second shaft 75Q. The second end of the transmission cable C3 (shown in FIGS. 1 and 2) is coupled to a first end 35A of the I/S lock lever 35. That is, the I/S lock lever 35 is operably coupled to the interior door lock knob H3 via the transmission cable C3. The I/S lock lever 35 pivots from the position shown in FIG. 5 to the position shown in FIG. 10 in response to a locking operation being performed on the interior door lock knob H3. The I/S lock lever 35 pivots from the position shown in FIG. 10 to the position shown in FIG. 5 in response to an unlocking operation being performed on the interior door lock knob H3.

As shown in FIGS. 5 and 6, a cam 35C is formed in an upper part of the I/S lock lever 35. As shown in FIG. 9, an operating part 35B projects toward the vehicle exterior from a surface of the I/S lock lever 35 that faces the vehicle exterior.

As shown in FIGS. 5 and 6, the worm wheel 39 is rotatably (turnably) supported by (on) the third shaft 75R. As shown in FIG. 9, a cam section 39C configured to engage with the cam 35C of the I/S lock lever 35 is formed on a surface of the worm wheel 39 that faces the vehicle exterior. When the electric motor M1 is actuated in response to a locking operation or an unlocking operation requested by a remote control key (e.g., a remote keyless entry fob) or the like, the worm wheel 39 is driven by the electric motor M1 to rotate and turns (pivots) clockwise or counterclockwise. Due to the engagement of the cam section 39C and the cam 35C, the worm wheel 39 causes the I/S lock lever 35 to pivot between the position shown in FIG. 5 and the position shown in FIG. 10.

As shown in FIGS. 5 and 6, the fourth shaft 75S is inserted through an elongated hole 40H that extends in the up-down direction, whereby the linearly moving lock lever 40 is supported by (on) the fourth shaft 75S so as to be linearly movable. The fourth shaft 75S has a substantial "C" shaped cross-section. The linearly moving lock lever 40 has a substantial "Y" shape that forks above the elongated hole 40H.

As shown in FIGS. 6 and 9, a linearly moving convex segment 40E projects toward the vehicle exterior from a part of the linearly moving lock lever 40 that branches rearward and upward. As shown in FIG. 7, a linear-movement guide groove 71E extends in the up-down direction at a location that is upward and rearward relative to the fourth shaft section 75S; the linear-movement guide groove 71E is formed as recess in the first base wall 71 of the first housing 70. The linearly moving convex segment 40E is guided by the linear-movement guide groove 71E, whereby the linearly moving lock lever 40 is capable of linearly moving in the up-down direction without inclining (tilting).

As shown in FIGS. 5 and 6, a concave recess 40B is formed in the lower end portion of the linearly moving lock lever 40. As shown in FIG. 5, the operating part 35B of the I/S lock lever 35 engages in the concave recess 40B.

As shown in FIG. 9, an engaging convex part 40C projects toward the vehicle exterior at (from) the distal end of a part of the linearly moving lock lever 40 that branches forward and upward. As shown in FIGS. 5, 10, 15, and 16, the engaging convex part 40C projects into the engaging concave segment 30D of the O/S lock lever 30.

Figure 10:
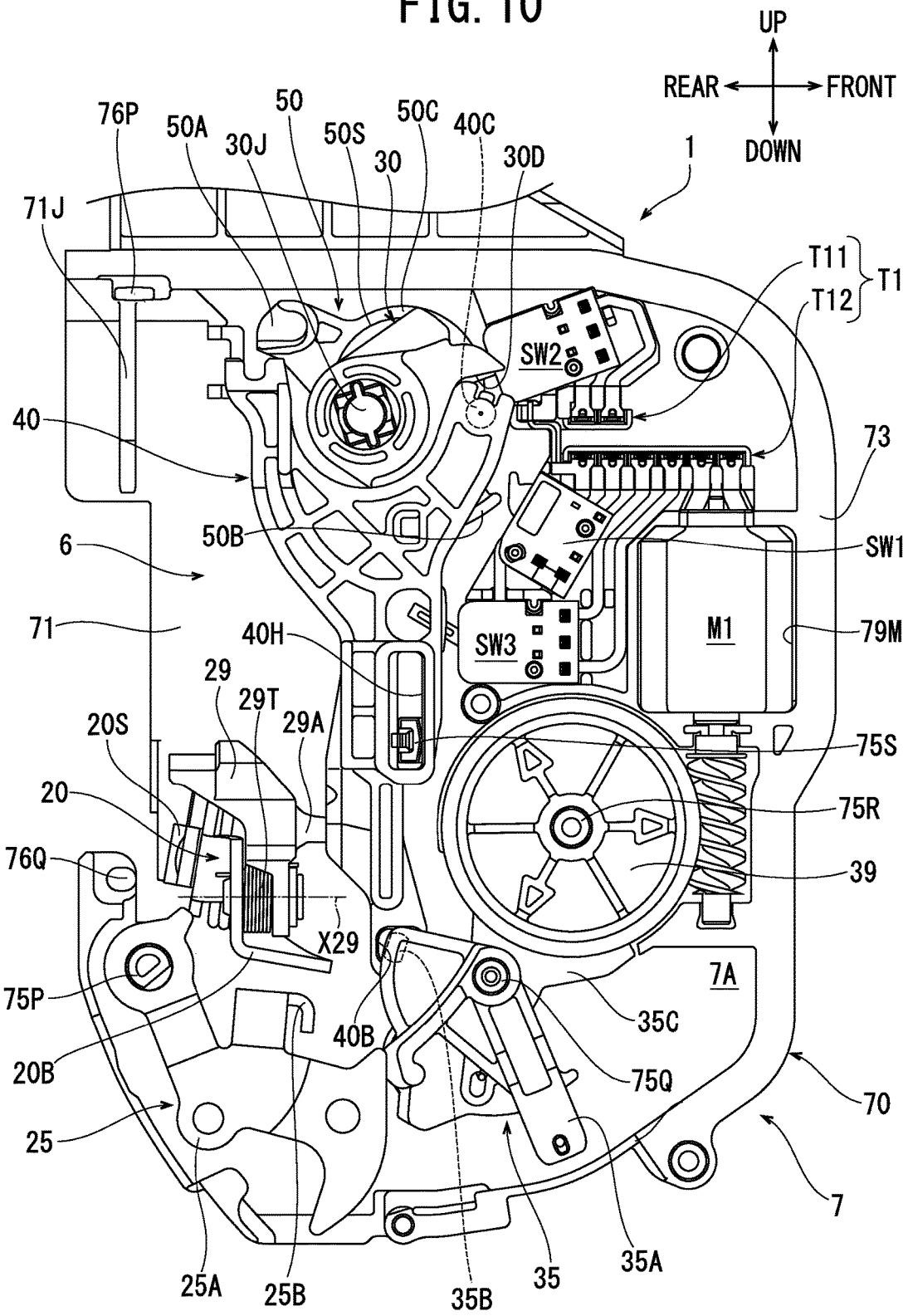
FIG. 10 is a front view of the first housing and the actuating mechanism.

When the I/S lock lever 35 pivots from the position shown in FIG. 5 to the position shown in FIG. 10 in response to a locking operation being performed on the interior door lock knob H3 or a locking operation requested by the remote control key or the like, the displacement of the I/S lock lever 35 is transmitted to the linearly moving lock lever 40 via the concave recess 40B and the operating part 35B. As a result thereof, the linearly moving lock lever 40 is pushed up from the position shown in FIG. 5 to the position shown in FIG. 10.

When the I/S lock lever 35 pivots from the position shown in FIG. 10 to the position shown in FIG. 5 in response to an unlocking operation being performed on the interior door lock knob H3 or an unlocking operation requested by the remote control key or the like, the displacement of the I/S lock lever 35 is transmitted to the linearly moving lock lever 40 via the concave recess 40B and the operating part 35B. As a result thereof, the linearly moving lock lever 40 is pulled down from the position shown in FIG. 10 to the position shown in FIG. 5.

When the O/S lock lever 30 pivots counterclockwise in response to the locking operation being performed on the key cylinder H2, the displacement of the O/S lock lever 30 is transmitted to the linearly moving lock lever 40 via the engaging concave segment 30D and the engaging convex part 40C. As a result thereof, the linearly moving lock lever 40 is lifted (pulled up) from the position shown in FIG. 5 to the position shown in FIG. 10.

When the O/S lock lever 30 pivots clockwise in response to the unlocking operation being performed on the key cylinder H2, the displacement of the O/S lock lever 30 is transmitted to the linearly moving lock lever 40 via the concave recess 40B and the operating part 35B. As a result thereof, the linearly moving lock lever 40 is pushed down from position shown in FIG. 10 to the position shown in FIG. 5.

As shown in FIGS. 9 and 11-14, a first surface 44A, a second surface 44B, and a third surface 44C are formed on the linearly moving lock lever 40 between the elongated hole 40H and the concave recess 40B. The first surface 44A, the second surface 44B, and the third surface 44C are formed on a surface of the linearly moving lock lever 40 that faces the vehicle exterior. The first surface 44A and the third surface 44C are each flat surfaces that extend in the up-down direction. The first surface 44A is displaced (shifted) more towards the vehicle interior than the third surface 44C. The second surface 44B is an inclined surface that connects the lower end of the first surface 44A with the upper end of the third surface 44C.

As shown in FIGS. 5, 6, and 11-14, a projection 29A projects forward from the front surface of the inertial lever 29. The projection 29A comes into slide-contact with the first surface 44A, the second surface 44B, and the third surface 44C in response to the linear movement of the linearly moving lock lever 40.

As shown in FIGS. 3 and 11-14, an inertial lever guide surface 90G is formed on the third housing 90 on the side of the housing chamber 7A. The inertial lever guide surface 90G is a downward flat surface located farther towards the vehicle exterior than the contacted portion 12B of the pawl 12. The inertial lever guide surface 90G extends toward the vehicle exterior so as to separate (be spaced) from the contacted portion 12B. As shown in FIG. 11, when the O/S open lever 20 has not yet been pivoted, the inertial lever guide surface 90G is located between the lower end of the contacted portion 12B and the upper end of the inertial lever 29 in the up-down direction.

The position of the linearly moving lock lever 40 shown in FIGS. 5, 11 to 12 is the same as the position of the linearly moving lock lever 40 shown in FIG. 5. The position of the linearly moving lock lever 40 shown in FIGS. 13 and 14 is the same as the position of the linearly moving lock lever 40 shown in FIG. 10.

When the linearly moving lock lever 40 is located at the position shown in FIGS. 11 and 12, the projection 29A of the inertial lever 29 comes into contact with the first surface 44A of the linearly moving lock lever 40, whereby the inertial lever 29 is retained in an upward position. In the state shown in FIG. 12, if the inertial lever 29 rises, the inertial lever 29 comes into contact with the contacted portion 12B and causes the pawl 12 to open the fork 11 so that the striker S1 can be released.

Figure 13:
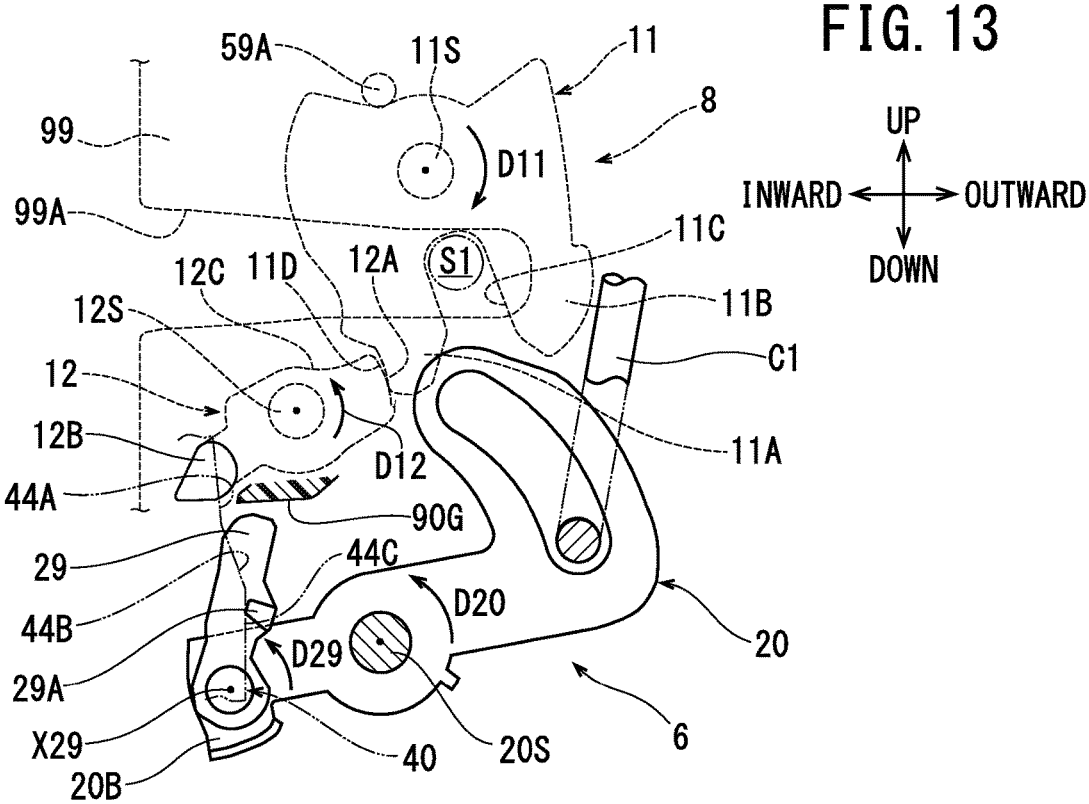
FIG. 13 is a third schematic view for explaining the operations of the O/S open lever, the inertial lever, the fork, and the pawl.
Figure 14:
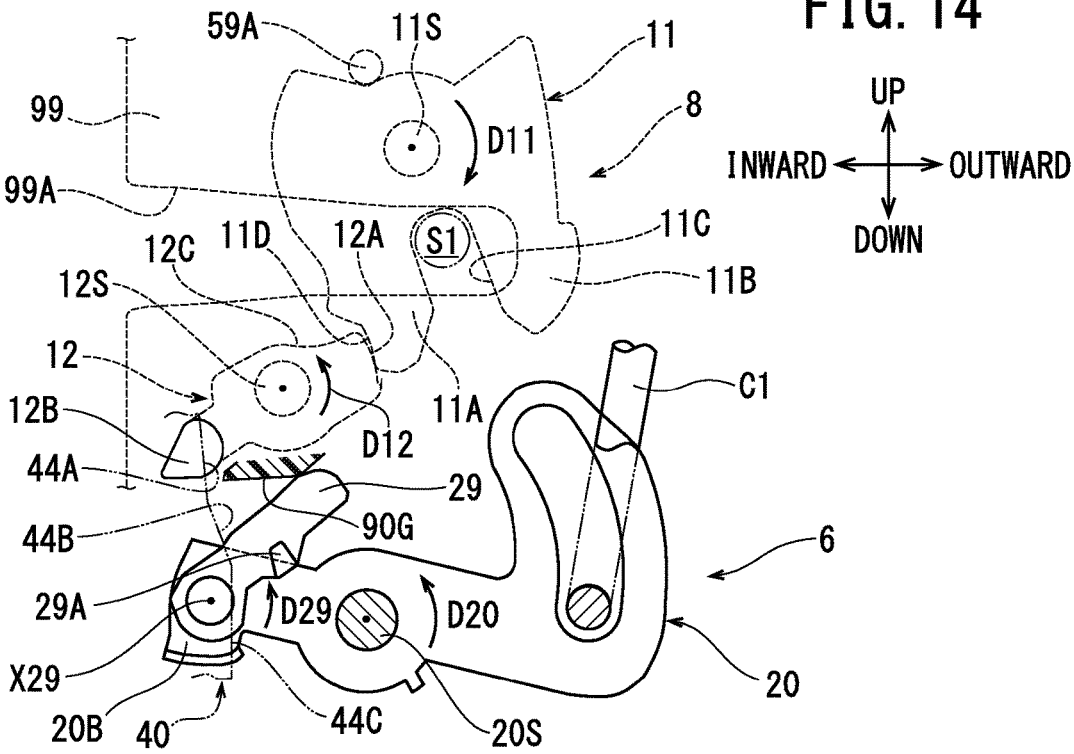
FIG. 14 is a fourth schematic view for explaining the operations of the O/S open lever, the inertial lever, the fork, and the pawl.

When the linearly moving lock lever 40 is displaced to the position shown in FIGS. 10, 13, and 14, the projection 29A of the inertial lever 29 comes into slide-contact with the second surface 44B of the linearly moving lock lever 40 and then comes into contact with the third surface 44C, whereby the inertial lever 29 is held inclined toward the vehicle exterior. In the state shown in FIG. 14, if the inertial lever 29 rises, the inertial lever 29 comes into contact with the inertial lever guide surface 90G, the inertial lever 29 separates from the contacted portion 12B, and the pawl 12 continues to fix (retain) the fork 11.

The position of the inertial lever 29 shown in FIGS. 11 and 12 is an unlock position where the inertial lever 29 is capable of acting on the pawl 12. The position of the inertial lever 29 shown in FIGS. 13 and 14 is a lock position where the inertial lever 29 is incapable of acting on the pawl 12. In the position shown in FIGS. 10, 13, and 14, the third surface 44C comes into contact with the projection 29A and the linearly moving lock lever 40 retains the inertial lever 29 in the lock position. The position of the linearly moving lock lever 40 shown in FIGS. 10, 13, and 14 is a locked position.

In the position shown in FIGS. 5, 11, and 12, the third surface 44C separates (is spaced) from the projection 29A and the linearly moving lock lever 40 does not hold the inertial lever 29 in the lock position shown in FIGS. 13 and 14. The inertial lever 29 brings the projection 29A into contact with the first surface 44A due to the urging force of the torsion coil spring 29T. When an impact (shock or impulse) acts on the inertial lever 29 (e.g., due to a vehicle side collision), the inertial lever 29 causes the projection 29A to separate from the first surface 44A and is displaced to the lock position. The position of the linearly moving lock lever 40 shown in FIGS. 5, 11, and 12 is an unlocked position.

In the unlocked position shown in FIGS. 5, 11, and 12, the linearly moving lock lever 40 causes the inertial lever 29 to stand upright and enables the fork 11 located in the latch position shown in FIG. 11 to be displaced to the unlatch position shown in FIG. 12. In the locked position shown in FIGS. 10, 13, and 14, the linearly moving lock lever 40 inclines the inertial lever 29 and disables (prevents) the fork 11 located in the latch position shown in FIG. 11 from being displaced to the unlatch position shown in FIG. 12.

When the linearly moving lock lever 40 is displaced to the unlocked position as shown in FIG. 5, the linearly moving lock lever 40 turns ON one of the contacts in the third switch SW3. When the linearly moving lock lever 40 is displaced to the locked position as shown in FIG. 10, the linearly moving lock lever 40 turns ON another contact in the third switch SW3. The ON/OFF signals of the two contacts in the third switch SW3 are used to control the locking and unlocking of the door and to ascertain the state of the door lock apparatus 1.

As shown in FIG. 2, the projecting end portions of the plurality of terminals T1 project into the connector mating part 80C formed on the outer side of the second housing 80. On the other hand, as shown in FIGS. 15 and 17, the other (remaining) portions of the plurality of terminals T1 are housed in the housing chamber 7A.

As shown in FIGS. 15, 17, and 18, the terminals T1 are arranged in two rows such that three of the terminals T11 are located in an upper row and six of the terminals T12 are located in a lower row. The upper and lower rows extend at least substantially in parallel. The plurality of terminals T11 in the upper row include a first ground terminal THE and second switch terminals T11A and T11B. The plurality of terminals T12 in the lower row include a second ground terminal T12E, a first switch terminal T12A, third switch terminals T12C and T12D, and motor terminals T12M and T12N. The plurality of terminals T12 in the lower row is a representative, non-limiting example of a "plurality of terminals in the first row" according to the present teachings. The plurality of terminals T11 in the upper row are a representative, non-limiting example of a "plurality of terminals in the second row" according to the present teachings.

As shown in FIGS. 15, 17, and 18, a first terminal holder 77, a second terminal holder 78, switch fixing parts 79A, 79B, 79C, 79D, 79E, 79F, and a motor chamber 79M are formed in the first base wall 71 of the first housing 70.

The first terminal holder 77 is disposed at (on) an upper and frontward corner section of the first base wall 71. In the first terminal holder 77, the first ground terminal THE and the second switch terminals T11A and T11B, which are a representative plurality of terminals T11 in the upper row, are arranged and held in one row in the front-rear direction.

The second terminal holder 78 is disposed below the first terminal holder 77. In the second terminal holder 78, the second ground terminal T12E, the first switch terminal T12A, the third switch terminals 112C and 112D, and the motor terminals 112M and 112N, which are a representative plurality of terminals T12 in the lower row, are also arranged and held in one row in the front-rear direction.

As shown in FIG. 18, one end portion 100 of the first ground terminal T11E is bent in a U-shape. The second ground terminal T12E branches into a plurality of terminals. As shown in FIG. 17, one end portion 101 extending upward of the second ground terminal T12E is held in the U-shaped portion 100, whereby the first ground terminal T11E and the second ground terminal T12E are electrically connected.

As shown in FIGS. 17 and 18, a rib-like switch fixing part 79A and a columnar switch fixing part 79B are formed between the first terminal holder 77 and an upper side portion of the first peripheral edge section 73 of the first housing 70. As shown in FIG. 17, the switch fixing parts 79A and 79B fit in the second switch SW2, whereby the second switch SW2 is retained by the first base wall 71. At this time, the first ground terminal T11E and the second switch terminals T11A and T11B enter the second switch SW2 and are electrically connected.

As shown in FIGS. 17 and 18, columnar switch fixing parts 79C and 79D are respectively formed below the rear end of the second terminal holder 78. As shown in FIG. 17, the switch fixing parts 79C and 79D fit in the first switch SW1, whereby the first switch SW1 is retained by the first base wall 71. At this time, the second ground terminal T12E and the first switch terminal T12A enter the first switch SW1 and are electrically connected.

As shown in FIG. 17, a rib-like switch fixing part 79E and a columnar switch fixing part 79F are formed below the switch fixing parts 79C and 79D. The switch fixing parts 79E and 79F fit in the third switch SW3, whereby the third switch SW3 is retained by the first base wall 71. At this time, the second ground terminal T12E and the third switch terminals T12C and T12D enter the second switch SW2 and are electrically connected.

As shown in FIGS. 17 and 18, the motor chamber 79M is formed as a recess extending in the vehicle outward direction at a position that is lower than the front end of the second terminal holder 78 and is adjacent to the front side of the first peripheral edge section 73. As shown in FIG. 17, the electric motor M1 fits in the motor chamber 79M, whereby the electric motor M1 is retained by the first base wall 71. At this time, the motor terminals T12M and T12N are electrically connected to the electric motor M1.

As shown, e.g., in FIGS. 15 and 17, the plurality of terminals T1 is surrounded by the first switch SW1, the second switch SW2, the third switch SW3, and the electric motor M1. When the plurality of terminals T1 is vertically sandwiched by (interposed between) the second switch SW2, the first switch SW1, and the third switch SW3, the second switch SW2 is connected to the plurality of terminals T11 (T11E, T11A, and T11B) in the upper row and the first switch SW1 is connected to the plurality of terminals T12 (T12E and T12A) in the lower row.

The above-described representative door lock apparatus 1, which has such a configuration, can hold the door closed with respect to the vehicle frame, open the door, and lock or unlock the door in the closed state in response to different types of operations performed by an occupant of the vehicle.

Operation and Effects

In the door lock apparatus 1 of the above-described embodiment as shown, e.g., in FIGS. 15 and 17, the plurality of terminals T1 is arranged in the two rows such that one plurality of terminals T11 is located in the upper row and another plurality of terminals T12 is located in the lower row and all of the terminals T11, T12 are surrounded by the first switch SW1, the second switch SW2, the third switch SW3, and the electric motor M1. More specifically, when the plurality of terminals T1 is vertically sandwiched by (interposed between) the first switch SW1 and the second switch SW2, the second switch SW2 is connected to the plurality of terminals T11 (T11E, T11A, and T11B) in the upper row and the first switch SW1 is connected to the plurality of terminals T12 (T12E and T12A) in the lower row. Furthermore, the third switch SW3 is connected to the plurality of terminals T12 (T12E, T12C, and T12D) in the lower row and the electric motor M1 is connected to the plurality of terminals T12 (T12M and T12N) in the lower row. Consequently, all of the terminals T1 are disposed in the vicinities of the first switch SW1, the second switch SW2, the third switch SW3, and the electric motor M1. It is therefore possible to reduce the lengths of the first ground terminal T11E, the second switch terminals T11A and T11B, the second ground terminal T12E, the first switch terminal T12A, the third switch terminals T12C and T12D, and the motor terminals T12M and T12N.

Therefore, it is possible to achieve a reduction in size by utilizing the design of the door lock apparatus 1 of the above-described embodiment.

In addition, in the door lock apparatus 1 of the above-described embodiment, even though a large number of structural elements, such as the inertial lever 29, the linearly moving lock lever 40, the adjuster SW lever 50, the O/S lock lever 30, and the electric motor M1, are housed in the housing chamber 7A of the actuating housing 7, it is possible to reduce the lengths of the terminals T1 and reliably achieve a reduction in size because the structural elements and the terminals T1 (T11 and T12) are all stored (accommodated) together.

In the door lock apparatus 1 of the above-described embodiment as shown, e.g., in FIGS. 15 to 17, the adjuster SW lever 50 functions as a first detection lever, the O/S lock lever 30 functions as a second detection lever, and these levers 30, 50 are housed in the housing chamber 7A together with the first switch SW1 and the second switch SW2. Therefore, it is not necessary to provide installation spaces for the adjuster SW lever 50, the O/S lock lever 30, the first switch SW1, and the second switch SW2 separately in the latch chamber 9A and the housing chamber 7A.

As shown, e.g., in FIGS. 17 and 18, the first axis X50 of the adjuster SW lever 50 is defined by the annular first guide surface 61. The second axis X30 of the O/S lock lever 30 is shifted with respect to the first axis X50 and is defined by the second guide surface 62, which is located farther in the inward direction than the first guide surface 61. The adjuster SW lever 50 and the O/S lock lever 30 are stacked (disposed in series) in the vehicle inward-outward direction, in which the first axis X50 and the second axis X30 extend. By utilizing such a layout configuration of the adjuster SW lever 50, the O/S lock lever 30, the first switch SW1, and the second switch SW2 in the door lock apparatus 1 as shown, e.g., in FIGS. 15 to 17, it is possible to easily dispose the adjuster SW lever 50, the O/S lock lever 30, the first switch SW1, and the second switch SW2 in positions close to one another while avoiding interference of the levers and the switches. That is, layout design flexibility is improved.

In the door lock apparatus 1 as shown in FIGS. 17 and 18, the spring housing 69 is provided farther inward than the first guide surface 61. That is, the spring housing 69 is provided in a space formed because the second axis X30 is shifted downward with respect to the first axis X50. Consequently, as compared to an embodiment in which the installation space for the urging spring 50T is provided farther outward than the first guide surface 61, it is possible to further reduce the size of the actuating housing 7.

Further, in the door lock apparatus 1 as shown, e.g., in FIGS. 15 and 17, the plurality of terminals T1 is surrounded by the first switch SW1, the second switch SW2, the third switch SW3, and the electric motor M1. When the plurality of terminals T1 is vertically sandwiched by (interposed between) the first switch SW1 and the second switch SW2, the second switch SW2 is connected to the plurality of terminals T11 (T11E, T11A, and T11B) in the upper row and the first switch SW1 is connected to a plurality of terminals T12 (T12E and T12A) in the lower row. Furthermore, the third switch SW3 is connected to a plurality of terminals T12 (T12E, T12C, and T12D) in the lower row and the electric motor M1 is connected to a plurality of terminals T12 (T12M and T12N) in the lower row. Consequently, the terminals T1 are disposed in the vicinities of the first switch SW1, the second switch SW2, the third switch SW3, and the electric motor M1. It is therefore possible to reduce the lengths of the first ground terminal T11E, the second switch terminals T11A and T11B, the second ground terminal T12E, the first switch terminal T12A, the third switch terminals T12C and T12D, and the motor terminals T12M and T12N. Therefore, it is possible to reduce the sizes of the installation spaces in the actuating housing 7 for the first switch SW1, the second switch SW2, the third switch SW3, and the electric motor M1. As a result, in the door lock apparatus 1 of the above-described embodiment, it is possible to further reduce the size of the actuating housing 7.

Although the present invention has been described above in line with a detailed embodiment, it is needless to say that the invention is not limited to the above-described detailed embodiment, and it may be appropriately modified in application without departing from the gist of the invention.

Features explained below are also disclosed in this application.

(Feature 1)

A vehicle door lock apparatus affixed to a door that is openable and closable relative to a vehicle frame and is capable of holding the door in a closed state with respect to the vehicle frame, the vehicle door lock apparatus including:

a housing having a latch chamber and a housing chamber formed in the interior thereof;

a latch mechanism housed in the latch chamber and capable of holding (retaining) the door closed with respect to the vehicle frame;

an actuating mechanism housed in the housing chamber and configured to actuate the latch mechanism;

a first detection lever housed in one of the latch chamber and the housing chamber, the first detection lever being pivotable about a first axis;

a first switch housed in the one of the latch chamber and the housing chamber and capable of detecting a first state of the latch mechanism or the actuating mechanism in accordance with displacement of the first detection lever;

a second detection lever housed in the one of the latch chamber and the housing chamber, the second detection lever being pivotable about a second axis that is parallel to the first axis; and a second switch housed in the one of the latch chamber and the housing chamber and capable of detecting a second state of the latch mechanism or the actuating mechanism in accordance with displacement of the second detection lever, wherein:

the first axis is defined by an annular first guide surface, the second axis is shifted with respect to the first axis and is defined by an annular second guide surface located farther inward than the first guide surface, and the first detection lever and the second detection lever are stacked (disposed in series) in a direction in which the first axis and the second axis extend.

(Feature 2)

The vehicle door lock apparatus described in the above feature 1, wherein a spring housing that houses an urging spring for urging the first detection lever or the second detection lever is provided farther inward than the first guide surface.

(Feature 3)

The vehicle door lock apparatus described in the above feature 1 or 2, further including a plurality of terminals provided in the housing and connected to the first switch and the second switch, wherein the first switch and the second switch surround the terminals.

(Feature 4)

The vehicle door lock apparatus described in any one of the above features 1 to 3, wherein:

a striker is affixed to the vehicle frame, the vehicle door lock apparatus is affixed to the door, the housing includes a latch housing, in which the latch chamber is formed, and an actuating housing assembled onto the latch housing, the housing chamber being formed in the actuating housing, an entry opening that the striker can enter is formed in the latch housing, the latch mechanism includes:

a fork that is pivotable in the latch housing and is movable between a latch position that holds the striker in the entry opening and an unlatch position that permits the striker to be removed from the entry opening; and a pawl that is pivotable in the latch housing to fix or release the fork, the actuating mechanism includes:

a first lever displaceably provided in the actuating housing, the first lever being displaceable by opening operation being performed on a door handle to act on the pawl, and being capable of causing the pawl to release the fork;

a second lever displaceably provided in the actuating housing, the second lever being displaceable to a locking position for retaining the first lever in a locked position, where the first lever is unable to act on the pawl, and to an unlocking position for not retaining the first lever in the locked position, the second lever enabling, in the unlocking position, displacement of the fork disposed in the latched position to the unlatched position and disabling, in the locking position, displacement of the fork disposed in the latched position to the unlatched position;

a third lever pivotably provided in the actuating housing, the third lever being displaceable to an interior light OFF position corresponding to the latched position and being displaceable to an interior light ON position corresponding to the unlatched position in association with the fork; and a fourth lever pivotably provided in the actuating housing, the fourth lever pivoting in response to an unlocking operation being performed on a key cylinder to displace the second lever from the locking position to the unlocking position and pivoting in response to a locking operation being performed on the key cylinder to displace the second lever from the unlocking position to the locking position, the first switch and the second switch are housed in the housing chamber, the third lever is the first detection lever, and the fourth lever is the second detection lever.

(Feature 5)

The vehicle door lock apparatus described in the above feature 4, further including:

a third switch housed in the housing chamber and capable of detecting a state of the second lever; and a plurality of terminals provided in the actuating housing and connected to the first switch, the second switch, and the third switch, wherein the first switch, the second switch, and the third switch surround the terminals.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved vehicle door lock apparatuses and methods for manufacturing and operating the same.

Moreover, combinations of features and steps disclosed in the above detail description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

The invention claimed is:

1. A vehicle door lock apparatus fixed between a vehicle frame and a door openable and closable with respect to the vehicle frame and capable of retaining the door closed with respect to the vehicle frame, the vehicle door lock apparatus comprising:

a housing having a latch chamber and a housing chamber formed in the interior thereof;

a latch mechanism housed in the latch chamber and configured to hold the door closed with respect to the vehicle frame;

an actuating mechanism housed in the housing chamber and configured to actuate the latch mechanism;

a first switch housed in one of the latch chamber and the housing chamber, the first switch being configured to detect a first state of the latch mechanism or the actuating mechanism;

a second switch housed in the one of the latch chamber and the housing chamber, the second switch being configured to detect a second state of the latch mechanism or the actuating mechanism; and a plurality of terminals provided in the housing and arranged in a first row and a second row;

wherein the first switch is connected to at least two of the terminals in the first row of the terminals and the second switch is connected to at least two of the terminals in the second row of the terminals, and the first and second rows of the terminals are at least partially sandwiched between the first switch and the second switch.

2. The vehicle door lock apparatus according to claim 1, wherein:

a striker is affixed to the vehicle frame, the vehicle door lock apparatus is affixed to the door, the housing includes a latch housing, in which the latch chamber is formed, and an actuating housing assembled onto the latch housing, the housing chamber being formed in the actuating housing, an entry opening configured to receive the striker is formed in the latch housing, the latch mechanism includes:

a fork pivotably provided in the latch housing, the fork being displaceable to a latched position, where the striker is retained in the entry opening, and to an unlatched position, where the striker is released to exit from the entry opening; and a pawl pivotably provided in the latch housing, the pawl being configured to fix or release the fork;

the actuating mechanism includes:

a first lever displaceably provided in the actuating housing, the first lever being displaceable by opening operation being performed on a door handle to act on the pawl, and being configured to cause the pawl to release the fork;

a second lever displaceably provided in the actuating housing, the second lever being displaceable to a locking position to retain the first lever in a locked position, where the first lever is unable to act on the pawl, and to an unlocking position to not retain the first lever in the locked position, the second lever enabling, in the unlocking position, displacement of the fork disposed in the latched position to the unlatched position and disabling, in the locking position, displacement of the fork disposed in the latched position to the unlatched position;

a third lever pivotably provided in the actuating housing, the third lever being displaceable in response to movement of the fork to an interior light OFF position corresponding to the latched position and being displaceable to an interior light ON position corresponding to the unlatched position; and a fourth lever pivotably provided in the actuating housing, the fourth lever being configured to pivot in response to an unlocking operation being performed on a key cylinder to displace the second lever from the locking position to the unlocking position and to pivot in response to a locking operation being performed on the key cylinder to displace the second lever from the unlocking position to the locking position, the first switch and the second switch are housed in the housing chamber, the first switch detects the first state according to displacement of the third lever, and the second switch detects the second state according to displacement of the fourth lever.

3. The vehicle door lock apparatus according to claim 2, further comprising:

a third switch housed in the housing chamber and being configured to detect a state of the second lever, wherein:

the third switch is connected to the first row of the terminals or to the second row of the terminals, and the first switch, the second switch, and the third switch surround the plurality of terminals.

4. The vehicle door lock apparatus according to claim 3, further comprising:

an electric motor housed in the housing chamber, the electric motor being configured to generate a driving force for displacing the second lever to the locking position and to the unlocking position, wherein:

the electric motor is connected to the first row of the terminals or to the second row of the terminals, and the first switch, the second switch, the third switch, and the electric motor surround the plurality of terminals.

5. A vehicle comprising:

a vehicle frame;

a door openable and closable with respect to the vehicle frame;

a vehicle door lock apparatus affixed to the door and comprising:

a housing having a latch chamber and a housing chamber formed in the interior thereof;

a latch mechanism housed in the latch chamber and configured to hold the door closed with respect to the vehicle frame;

an actuating mechanism housed in the housing chamber and configured to actuate the latch mechanism;

a first switch housed in one of the latch chamber and the housing chamber, the first switch being configured to detect a first state of the latch mechanism or the actuating mechanism;

a second switch housed in the one of the latch chamber and the housing chamber, the second switch being configured to detect a second state of the latch mechanism or the actuating mechanism; and terminals provided in the housing and arranged in a first row and a second row;

wherein the first switch is connected to a first plurality of the terminals in the first row, the second switch is connected to a second plurality of the terminals in the second row, and the first and second rows of the terminals are at least partially interposed between the first switch and the second switch.

6. The vehicle according to claim 5, wherein:

a striker is affixed to the vehicle frame, the housing includes a latch housing, in which the latch chamber is formed, and an actuating housing assembled onto the latch housing, the housing chamber being formed in the actuating housing, and an entry opening configured to receive the striker is formed in the latch housing.

7. The vehicle according to claim 6, wherein the latch mechanism includes:

a fork pivotably provided in the latch housing, the fork being displaceable to a latched position, where the striker is retained in the entry opening, and to an unlatched position, where the striker is released to exit from the entry opening; and a pawl pivotably provided in the latch housing, the pawl being configured to fix or release the fork.

8. The vehicle according to claim 7, wherein the actuating mechanism includes:

a first lever displaceably provided in the actuating housing, the first lever being displaceable in response to an opening operation being performed on a door handle to act on the pawl, and being configured to cause the pawl to release the fork;

a second lever displaceably provided in the actuating housing, the second lever being displaceable to a locking position to retain the first lever in a locked position, where the first lever is unable to act on the pawl, and to an unlocking position to not retain the first lever in the locked position, the second lever enabling, in the unlocking position, displacement of the fork disposed in the latched position to the unlatched position and disabling, in the locking position, displacement of the fork disposed in the latched position to the unlatched position;

a third lever pivotably provided in the actuating housing, the third lever being displaceable in response to movement of the fork to an interior light OFF position corresponding to the latched position and being displaceable to an interior light ON position corresponding to the unlatched position; and a fourth lever pivotably provided in the actuating housing, the fourth lever being configured to pivot in response to an unlocking operation being performed on a key cylinder to displace the second lever from the locking position to the unlocking position and to pivot in response to a locking operation being performed on the key cylinder to displace the second lever from the unlocking position to the locking position.

9. The vehicle according to claim 8, wherein:

the first switch and the second switch are housed in the housing chamber, the first switch is configured to detect the first state according to displacement of the third lever, and the second switch is configured to detect the second state according to displacement of the fourth lever.

10. The vehicle according to claim 9, further comprising:

a third switch housed in the housing chamber and being configured to detect a state of the second lever, wherein:

the third switch is connected to the first row of the terminals or to the second row of the terminals, and the first switch, the second switch, and the third switch surround the plurality of terminals.

11. The vehicle according to claim 10, further comprising:

an electric motor housed in the housing chamber, the electric motor being configured to generate a driving force for displacing the second lever to the locking position and to the unlocking position, wherein:

the electric motor is connected to the first row of the terminals or to the second row of the terminals, and the first switch, the second switch, the third switch, and the electric motor surround the plurality of terminals.

12. An apparatus comprising:

a housing having an interior defining a latch chamber and a housing chamber;

a latch mechanism housed in the latch chamber and configured to hold a vehicle door closed with respect to a vehicle frame;

an actuating mechanism housed in the housing chamber and configured to actuate the latch mechanism;

a first switch housed in one of the latch chamber and the housing chamber, the first switch being configured to detect a first state of the latch mechanism or the actuating mechanism;

a second switch housed in the one of the latch chamber and the housing chamber, the second switch being configured to detect a second state of the latch mechanism or the actuating mechanism; and terminals provided in the housing and arranged in a first row and a second row;

wherein the first switch is connected to a first plurality of the terminals in the first row, the second switch is connected to a second plurality of the terminals in the second row, and the first and second rows of the terminals are at least partially interposed between the first switch and the second switch.

13. The apparatus according to claim 12, wherein:

the housing includes a latch housing, in which the latch chamber is formed, and an actuating housing assembled onto the latch housing, the housing chamber being formed in the actuating housing, and an entry opening is formed in the latch housing and is configured to receive a striker affixed to the vehicle frame.

14. The apparatus according to claim 13, wherein the latch mechanism includes:

a fork pivotably provided in the latch housing, the fork being displaceable to a latched position, where the fork is configured to retain the striker in the entry opening, and to an unlatched position, where fork is configured to release the striker so that the striker is capable of exiting from the entry opening; and a pawl pivotably provided in the latch housing, the pawl being configured to fix or release the fork.

15. The apparatus according to claim 14, wherein the actuating mechanism includes:

a first lever displaceably provided in the actuating housing, the first lever being displaceable in response to an opening operation being performed on a door handle mounted on the vehicle door to act on the pawl, and being configured to cause the pawl to release the fork;

a second lever displaceably provided in the actuating housing, the second lever being displaceable to a locking position to retain the first lever in a locked position, where the first lever is unable to act on the pawl, and to an unlocking position to not retain the first lever in the locked position, the second lever enabling, in the unlocking position, displacement of the fork disposed in the latched position to the unlatched position and disabling, in the locking position, displacement of the fork disposed in the latched position to the unlatched position;

a third lever pivotably provided in the actuating housing, the third lever being displaceable in response to movement of the fork to an interior light OFF position corresponding to the latched position and being displaceable to an interior light ON position corresponding to the unlatched position; and a fourth lever pivotably provided in the actuating housing, the fourth lever being configured to pivot in response to an unlocking operation being performed on a key cylinder to displace the second lever from the locking position to the unlocking position and to pivot in response to a locking operation being performed on the key cylinder to displace the second lever from the unlocking position to the locking position.

16. The apparatus according to claim 15, wherein:

the first switch and the second switch are housed in the housing chamber, the first switch is configured to detect the first state according to displacement of the third lever, and the second switch is configured to detect the second state according to displacement of the fourth lever.

17. The apparatus according to claim 16, further comprising:

a third switch housed in the housing chamber and being configured to detect a state of the second lever, wherein:

the third switch is connected to the first row of the terminals or to the second row of the terminals, and the plurality of terminals is interposed between the first switch, the second switch and the third switch.

18. The apparatus according to claim 17, further comprising:

an electric motor housed in the housing chamber, the electric motor being configured to generate a driving force for displacing the second lever to the locking position and to the unlocking position, wherein:

the electric motor is connected to the first row of the terminals or to the second row of the terminals, and the plurality of terminals is interposed between the first switch, the second switch, the third switch, and the electric motor.

19. The vehicle door lock apparatus according to claim 1, wherein:

the first switch is housed in the housing chamber;

the second switch is housed in the housing chamber;

a connector mating part is formed on an outer side of the housing;

the second row of the terminals includes a first ground terminal that is housed entirely within the housing chamber and is connected to the second switch, the first row of the terminals includes a second ground terminal that is partially housed in the housing chamber and is connected to the first switch, a projecting end portion of the second ground terminal projects into the connector mating part, and the first ground terminal is connected to the second ground terminal.

20. The vehicle door lock apparatus according to claim 19, wherein:

an end portion of the first ground terminal includes a U-shaped portion; and an end portion of the second ground terminal is held within the U-shaped portion of the first ground terminal such that the first ground terminal is connected to the second ground terminal.

* * * * *